US010883349B2

(12) United States Patent
Campbell et al.

(10) Patent No.: US 10,883,349 B2
(45) Date of Patent: Jan. 5, 2021

(54) BOTTOM HOLE ASSEMBLY FOR CONFIGURING BETWEEN ARTIFICIAL LIFT SYSTEMS

(71) Applicant: Weatherford Technology Holdings, LLC, Houston, TX (US)

(72) Inventors: Thomas Scott Campbell, Katy, TX (US); Manish Agarwal, Cypress, TX (US); Jeffrey J. Lembcke, Cypress, TX (US); Michael C. Knoeller, Humble, TX (US); Toby S. Pugh, Arlington, TX (US); William C. Lane, The Woodlands, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 51 days.

(21) Appl. No.: 15/712,989

(22) Filed: Sep. 22, 2017

(65) Prior Publication Data

US 2019/0093461 A1 Mar. 28, 2019

(51) Int. Cl.
*E21B 43/12* (2006.01)
*E21B 43/38* (2006.01)
(Continued)

(52) U.S. Cl.
CPC ..... *E21B 43/123* (2013.01); *E21B 33/12* (2013.01); *E21B 34/06* (2013.01); *E21B 34/063* (2013.01);
(Continued)

(58) Field of Classification Search
CPC .... E21B 43/123; E21B 43/126; E21B 43/124; E21B 43/127; E21B 43/128; E21B 43/38;
(Continued)

(56) References Cited

U.S. PATENT DOCUMENTS 2,440,506 A * 4/1948 Furse ..... E21B 34/08 166/106
2001/0004937 A1* 6/2001 Leniek, Sr. ..... E21B 19/22 166/369

(Continued)

FOREIGN PATENT DOCUMENTS

WO 9915755 A2 4/1999

OTHER PUBLICATIONS

Weatherford, "KOBE Type-A Hydraulic Piston Pump," Brochure, copyright 2012, 2-pgs.

(Continued)

*Primary Examiner* — George S Gray
(74) *Attorney, Agent, or Firm* — Blank Rome, LLP

(57) ABSTRACT

A wellbore completion is configured for multiple forms of artificial lift. A downhole assembly on production tubing defines a production port communicating a throughbore with the wellbore annulus. A bypass, such as a snorkel or riser tube, on the assembly also communicates the throughbore between the packer and the production port with the annulus. A packer on the assembly seals in the annulus downhole of the production port and bypass. The assembly can then be configured for any selected artificial lift. To do this, at least one isolation (a sleeve insert, a sliding sleeve, a check valve, or a rupture disk) selectively prevents/allows communication via one or both of the production port and the bypass as needed. Additionally, removable lift equipment, including jet pump, gas lift valve, plunger assembly, rod pump, piston pump, or standing valve, is selectively inserted into the assembly's throughbore as needed.

33 Claims, 16 Drawing Sheets

(51) Int. Cl.
*E21B 34/06* (2006.01)
*E21B 33/12* (2006.01)
*E21B 34/00* (2006.01)

(52) U.S. Cl.
CPC ..... *E21B 43/124* (2013.01); *E21B 43/126* (2013.01); *E21B 2034/007* (2013.01)

(58) Field of Classification Search
CPC ..... E21B 33/12; E21B 34/063; E21B 34/06; E21B 2034/007
See application file for complete search history.

(56) References Cited

U.S. PATENT DOCUMENTS

2005/0230121 A1 10/2005 Martinez et al.
2011/0284238 A1* 11/2011 Berry ..... E21B 23/02 166/369
2014/0110133 A1* 4/2014 Ellithorp ..... E21B 43/127 166/378
2014/0305633 A1* 10/2014 Bracken ..... E21B 23/006 166/242.3
2016/0138380 A1* 5/2016 McCoy ..... E21B 43/38 166/265
2018/0223642 A1* 8/2018 Zahran ..... E21B 43/34

OTHER PUBLICATIONS

Weatherford, "Hydraulic Pumping Systems," Brochure, copyright 2003-2004, 4-pgs.
Weatherford, "Powerlift™I & II Pumps," Brochure, copyright 2002-2005, 2-pgs.
Weatherford, "Powerlift™ Jet Pumps," Brochure, copyright 2002-2005, 2-pgs.
Weatherford, "Three-Cup Bottom Holddown," Brochure, copyright 2005, 1-pg.
Weatherford, "SuperFlo Three-Cup Bottom Holddown," Brochure, copyright 2005, 1-pg.
Weatherford, "Kobe Type-A Hydraulic Piston Pump," Brochure, copyright 2012, 2-pg.
Weatherford, "Powerliftυ III Hydraulic Piston Pumps," Brochure, copyright 2012, 4-pgs.
Weatherford, "Hydraulic Piston-Pump Lifting Systems," Brochure, copyright 2015, 8-pgs.
Weatherford, "RapidFlo™ Plunger-Lift System," Brochure, copyright 2015, 12-pgs.
Lane, W. "Completion and Artificial Lift Strategies for the Life of the Well," Weatherford Presentation, copyright 2015, 23-pgs.
Weatherford, "Jet-Pump Lifting Systems," Brochure, copyright 2015, 8-pgs.

* cited by examiner

BOTTOM HOLE ASSEMBLY FOR CONFIGURING BETWEEN ARTIFICIAL LIFT SYSTEMS

BACKGROUND OF THE DISCLOSURE

Many hydrocarbon wells are unable to produce at commercially viable levels without assistance in lifting the formation fluids to the earth's surface. Various forms of artificial lift are used to produce from these types of wells. Typical forms of artificial lift include Hydraulic Jet Pump (HJP), Gas Lift (GL), Gas Assisted Plunger Lift (GA-PL), Reciprocating Rod Pump (RRP), and Hydraulic Piston Pump (HPP).

For example, a well that produces oil, gas, and water may be assisted in the production of fluids with a reciprocating pump system, such as sucker rod pump systems. In this type of system, fluids are extracted from the well using a downhole pump connected to a driving source at the surface. A rod string connects the surface driving force to the downhole pump in the well. When operated, the driving source cyclically raises and lowers the downhole pump, and with each stroke, the downhole pump lifts well fluids toward the surface.

Different forms of artificial lift may be more suited to produce the well throughout its life. Transitioning from one form of lift to another can be very costly especially when the transition requires operators to re-complete the well and to install appropriate equipment. The costs associated with such requirements typically discourage operators from transitioning from one form of lift to another. Consequently, many wells may not be updated with appropriate lift system so the wells are not produced at their optimum levels.

The subject matter of the present disclosure is directed to overcoming, or at least reducing the effects of, one or more of the problems set forth above.

SUMMARY OF THE DISCLOSURE

According to the present disclosure, a completion apparatus is useable for artificial lift with production tubing in a wellbore. The apparatus comprises a downhole assembly, a packer, a bypass, at least one isolation, and lift equipment. The downhole assembly is disposed on the production tubing in the wellbore and defines a throughbore. The packer is disposed on the downhole assembly and seals the annulus downhole of the production port.

A production port defined on the assembly uphole of the packer communicates the throughbore with an annulus of the wellbore. The bypass is disposed on the downhole assembly uphole of the packer also. The bypass communicates with the throughbore between the packer and the production port and communicates with the annulus.

The at least one isolation is disposed on the downhole assembly and selectively prevents and allows communication via one or both of the production port and the bypass, as discussed later. Finally, the lift equipment is selectively insertable into the throughbore and configures the downhole assembly for a number of forms of artificial lift, including, but not limited to, gas lift, hydraulic lift with a hydraulic jet pump, plunger lift, gas-assisted plunger lift, mechanical lift with a reciprocating rod pump, and hydraulic lift with a hydraulic piston pump. Additionally, the lift equipment selectively insertable into the throughbore can configure the downhole assembly for normal production, if possible from the formation.

According to the present disclosure, a method completes a wellbore for multiple forms of artificial lift. The method comprises: disposing a downhole assembly on production tubing in the wellbore, the downhole assembly defining a throughbore and defining a production port communicating the throughbore with an annulus of the wellbore, the downhole assembly having a bypass communicating with the throughbore between the packer and the production port and communicating with the annulus; sealing a packer on the downhole assembly in the annulus downhole of the production port; and configuring the downhole assembly for any selected one of the multiple forms of artificial lift. This is done by: selectively preventing and allowing communication with at least one isolation via one or both of the production port and the bypass; and selectively inserting lift equipment into the throughbore configured for the selected form of artificial lift.

In the method, selectively inserting the lift equipment into the throughbore can comprise one or more of: inserting multiple components of the lift equipment integrated together; running more than one component of the lift equipment together at a same time into the throughbore; and running one or more components of the lift equipment in the throughbore using one of wireline, slickline, and coiled tubing.

Selectively inserting the lift equipment into the throughbore can comprise selectively sealing one or more components of the inserted lift equipment with one or more of a plurality of bore seals disposed in the throughbore. As such, the downhole assembly can include a plurality of bore seals disposed in the throughbore that selectively seal with the inserted lift equipment. For example, a first bore seal can be disposed in the throughbore downhole of the communication of the bypass; a second bore seal can be disposed in the throughbore between the production port and the communication of the bypass; and a third bore seal can be disposed in the throughbore uphole of the production port.

In one embodiment, the at least one isolation comprises at least one sleeve insert selectively insertable into the throughbore and sealable therein relative to one or both of the production port and the bypass. For example, one sleeve insert of shorter length can isolate the production port and seal with the first and second bore seals. Another sleeve insert could be used to then isolate the bypass. Alternatively, one sleeve insert of greater length can isolate both the production port and the bypass and can seal with the bore seals.

In another embodiment, the at least one isolation comprises at least one sliding sleeve movably disposed in the throughbore between open and closed conditions relative to one or both of the production port and the bypass. As with the sleeve insert, one or more of such sliding sleeves can be used to isolate one or both of the production port and the bypass. For the bypass, however, one form of the at least one isolation can include a check valve or a rupture disk controlling communication via the bypass. In another alternative, an injection valve can also be disposed on the downhole assembly adjacent the bypass and can communicate a capillary string from surface with the annulus of the wellbore.

In the method, selectively preventing and allowing communication with the at least one isolation via one or both of the production port and the bypass comprises one of: selectively inserting at least one sleeve insert into the throughbore and sealable therein relative to one or both of the production port and the bypass; moving at least one sliding sleeve insert in the throughbore between open and closed conditions relative to one of the production port and the bypass;

controlling communication via the bypass with a check valve; and controlling communication via the bypass with a rupture disk.

The assembly can be configured for gas lift or gas-assisted lift. For this, the downhole assembly comprises a gas lift valve disposed thereon and controlling communication between the annulus and the throughbore. For example, to configure the downhole assembly for gas lift, the at least one isolation prevents the communication via both the bypass and the production port.

In the method, configuring the downhole assembly for gas lift can comprises: configuring conduction of production fluid with the at least one isolation by preventing the communication via both of the production port and the bypass; and controlling communication of gas from the annulus into the production fluid in the throughbore.

The gas lift valve can be integrated into a gas lift mandrel of the assembly disposed on the production tubing. Other forms of gas lift valves and mandrel could be used. Moreover, for other forms of artificial lift besides gas lift or gas assisted lift, the gas lift valves may be removable and replaced with dummy valves, the gas lift valves may remain on the assembly but the lift operation may not expose the valve to an operational pressure differential, or the remaining gas lift valves can be independently isolated.

The downhole assembly can be configured for hydraulic lift using a hydraulic jet pump. To do this, the at least one isolation prevents the communication via the bypass and allows the communication via the production port. The hydraulic jet pump is inserted in the throughbore and has an inlet receiving production fluid from the downhole throughbore. A standing valve can be disposed at the inlet of the hydraulic jet pump.

In the method, configuring the downhole assembly for hydraulic lift can comprise: configuring conduction of production fluid with the at least one isolation by preventing the communication via the bypass and allowing the communication via the production port; inserting a hydraulic jet pump in the throughbore, the hydraulic jet pump having an inlet receiving production fluid from the downhole throughbore, an input receiving power fluid from the uphole throughbore, and an outlet for mixed production and power fluid, the outlet port in communication with the annulus via the production port; and positioning a standing valve at the inlet of the hydraulic jet pump.

The hydraulic jet pump can be operated under to flow schemes. In one example, the hydraulic jet pump has an input receiving power fluid from the uphole throughbore, and has an outlet in communication with the annulus via the production port for discharging mixed production and power fluid. In a reverse scheme, the hydraulic jet pump has an input in communication with the annulus via the production port for receiving power fluid, and has an outlet in communication with the throughbore uphole for discharging mixed production and power fluid.

The downhole assembly can be configured for plunger lift. To do this, the at least one isolation prevents the communication via both the bypass and the production port. The lift equipment includes a plunger assembly inserted in the throughbore and having an inlet receiving production fluid from downhole. A standing valve can be disposed at the inlet of the plunger assembly.

The plunger lift arrangement can be further assisted with gas, when the downhole assembly comprises a gas lift valve disposed thereon and controlling communication between the annulus and the throughbore. The plunger assembly can be inserted in the throughbore adjacent the gas lift valve. An inlet of the plunger assembly can receive production fluid from downhole and can be exposed to injected gas from the gas lift valve.

In the method, configuring the downhole assembly for gas-assisted plunger lift can comprise: configuring conduction of production fluid with the at least one isolation by preventing the communication via both the bypass and the production port; controlling communication of gas from the annulus into the production fluid in the throughbore with a gas lift valve disposed on the downhole assembly; inserting a plunger assembly in the throughbore adjacent the gas lift valve and having an inlet receiving production fluid from downhole; and positioning a standing valve at the inlet of the plunger assembly.

The downhole assembly can be configured for mechanical lift using a reciprocating rod pump. To do this, the at least one isolation allows the communication via both the bypass and the production port. The lift equipment includes an inlet inserted in the throughbore and sealed in fluid communication with the production port. The reciprocating rod pump is inserted in the throughbore uphole of the production port and receives production fluid from the production port via the inlet.

In the method, configuring the downhole assembly for mechanical lift can comprise: configuring conduction of production fluid with the at least one isolation by allowing the communication via both the bypass and the production port; inserting an inlet in the throughbore and sealed in fluid communication with the production port; and inserting a reciprocating rod pump in the throughbore uphole of the inlet to receive the production fluid from the production port via the permeable conduit.

The inlet can include a permeable conduit, a plug, and a holddown. For example, the permeable conduit is inserted in the throughbore adjacent the production port. The plug disposed on a downhole end of the conduit is sealed in a lower seal bore of the throughbore, and the holddown disposed on an uphole end of the conduit is sealed in an upper seal bore of the throughbore.

In another way to configure the downhole assembly for mechanical lift using a reciprocating rod pump, the at least one isolation allows the communication via both the bypass and the production port. The lift equipment includes an inlet inserted in the throughbore and sealed in fluid communication with the production port. An anchor is inserted in the throughbore uphole of the inlet, and the reciprocating rod pump is inserted in the throughbore uphole of the anchor and receives production fluid from the production port through the inlet and the anchor.

In the method, configuring the downhole assembly for mechanical lift can comprise: configuring conduction of production fluid with the at least one isolation by allowing the communication via both the bypass and the production port; inserting an inlet in the throughbore and sealed in fluid communication with the production port; inserting an anchor in the throughbore uphole of the inlet; and inserting a reciprocating rod pump in the throughbore uphole of the anchor to receive the production fluid from the production port through the inlet and the anchor.

The inlet for this configuration can include a permeable conduit inserted in the throughbore adjacent the production port and can include a plug disposed on a downhole end and sealed in a lower seal bore of the throughbore.

The downhole assembly can be configured for hydraulic lift using a hydraulic piston pump. To do this, the at least one isolation prevents the communication via the bypass and allows the communication via the production port. The hydraulic piston pump is inserted in the throughbore and has an inlet receiving production fluid from the downhole throughbore. An input of the pump receives power fluid, and an outlet for mixed production and power fluid is in communication with the production port. A standing valve can be disposed at the inlet of the hydraulic piston pump.

In the method, configuring the downhole assembly for hydraulic lift can comprise: configuring conduction of production fluid with the at least one isolation by preventing the communication via the bypass and allowing the communication via the production port; inserting a hydraulic piston pump in the throughbore, the hydraulic piston pump having an inlet receiving production fluid from the downhole throughbore, an input receiving power fluid, and an outlet for mixed production and power fluid, the outlet port in communication with the production port; and positioning a standing valve at the inlet of the hydraulic jet pump.

In another way to configure the downhole assembly for hydraulic lift using a hydraulic piston pump, the at least one isolation allows the communication via both the bypass and the production port. An inlet is inserted in the throughbore and is sealed in fluid communication with the production port. The hydraulic piston pump is inserted in the throughbore uphole of the inlet. The hydraulic piston pump receives production fluid from the production port via the inlet. An outlet for mixed production and power fluid is in fluid communication with the uphole throughbore. The pump include an input for power fluid, and a second conduit disposed in the uphole throughbore communicates with the input. A standing valve can be disposed at the inlet of the pump.

In the method, configuring the downhole assembly for hydraulic lift can comprise: configuring conduction of production fluid with the at least one isolation by allowing the communication via both the bypass and the production port; inserting an inlet in the throughbore and sealed in fluid communication with the production port; inserting a hydraulic piston pump in the throughbore uphole of the inlet, the hydraulic piston pump receiving production fluid from the production port via the inlet, an input for power fluid, and an outlet for mixed production and power fluid, the outlet in fluid communication with the uphole throughbore; positioning a standing valve at the inlet of the hydraulic piston pump; and positioning a second conduit in the uphole throughbore to communicate with the input of the hydraulic piston pump.

The foregoing summary is not intended to summarize each potential embodiment or every aspect of the present disclosure.

DETAILED DESCRIPTION OF THE DISCLOSURE

Figures 1, 2:
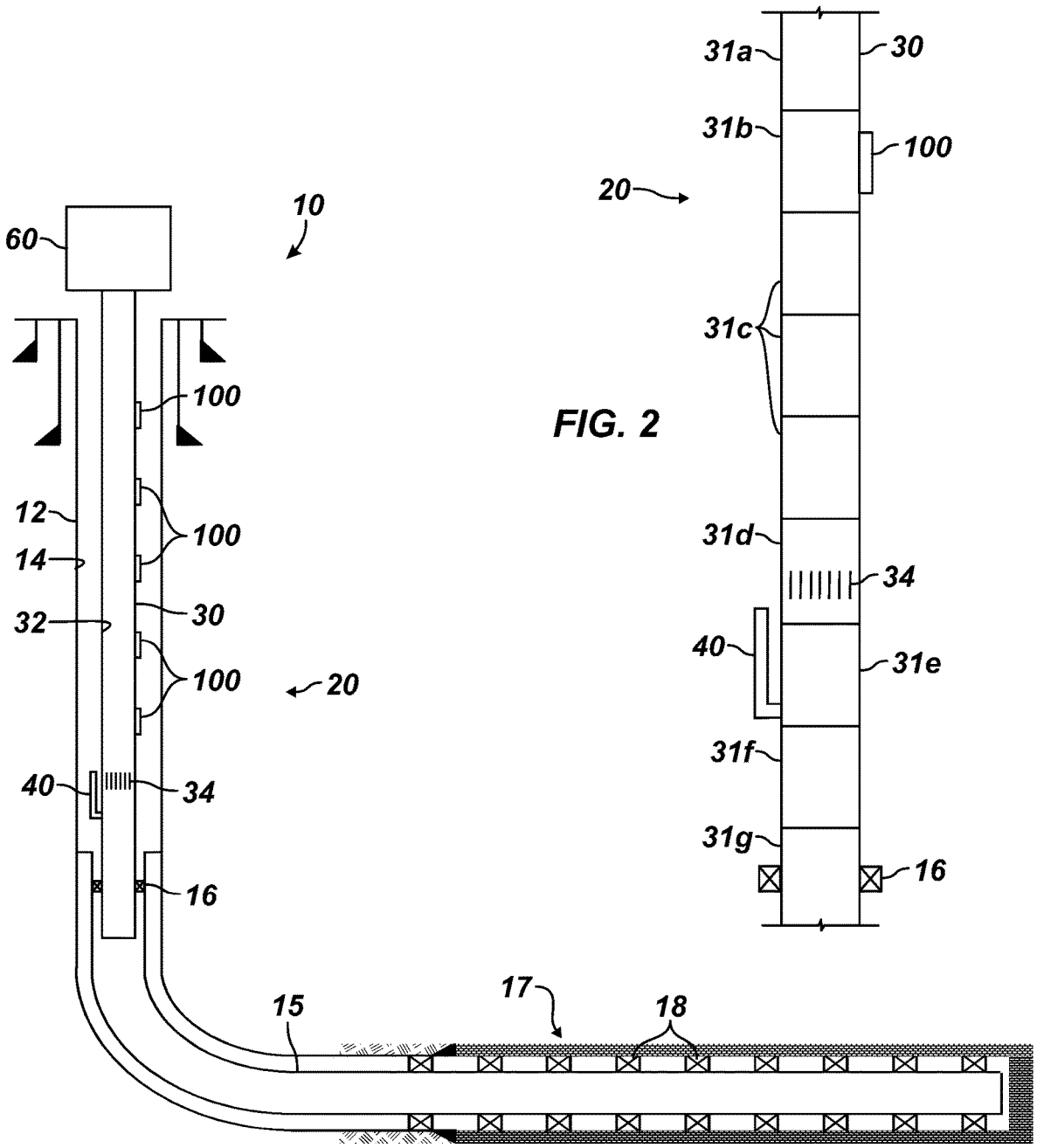
FIG. 1 illustrates a completion system having one embodiment of a bottom hole assembly according to the present disclosure.
FIG. 2 illustrates one configuration of the bottom hole assembly of the present disclosure having separate components.

FIG. 1 illustrates a completion system 10 having one embodiment of a downhole or bottom hole assembly 20 according to the present disclosure. The completion 10 includes casing 12 extending in the well to one or more production zones 17 downhole in a formation. As will be appreciated, the casing 12 typically includes a liner 15 having perforations, screens, isolation packers, inflow control devices, sliding sleeves, or the like at the production zones 17 for entry of formation fluids into the annulus 14 for eventual lifting to surface equipment 60.

The bottom hole assembly 20 disposed on the production tubing in the wellbore defines a throughbore 32 and defines a production port 34 communicating the throughbore 32 with the annulus 14. A packer 16 disposed on the assembly 20 seals the annulus 14 downhole of the production port 34.

A bypass 40 disposed on the assembly 20 communicates with the throughbore 32 between the packer 16 and the production port 34 and communicates with the annulus 14. The bypass 40 in the form of a snorkel tube can extend uphole toward the production port 34.

The assembly 20 is capable of transitioning from one form of lift to another, throughout the life of the well, without needing to recomplete the well. To do this, at least one isolation (not shown) disposed on the downhole assembly can selectively prevent and allow communication via one or both of the production port 34 and the bypass 40. Additionally, lift equipment (not shown) is selectively insertable into the throughbore 32 and configures the assembly for a selected form of artificial lift, as well as for normal production if possible.

A typical well may start its life with a high production rate produced by the natural flow of produced fluids from the well. As the formation is depleted, the production rate falls so that early forms of artificial lift are needed. Eventually, later forms of artificial lift may then be needed during the life of the well. The bottom hole assembly 20 can be configured with lift equipment that can follow a progression of artificial lift suited to the lift of the well. For example, the bottom hole assembly 20 can configured to start with a Hydraulic Jet Pump (HJP) and can then be transitioned to Gas Lift (GL), then to Gas assisted Plunger Lift (GA-PL), and then finally to Reciprocating Rod Pump (RRP) or Hydraulic Piston Pump (HPP) without pulling the tubing and only utilizing wireline or other deployment procedures to run and retrieve downhole equipment. The bottom hole assembly 20 can be configured for these and other forms of artificial lift.

The historical solution for the changing needs of a well is to recomplete the well based on the particular forms of lift required for the well. The disclosed system, however, can transition from one form of lift to another without needing to re-complete (pull the tubing) the well. In this way, the assembly 20 not only saves installation costs, but provides the option to deploy appropriate lift equipment suitable for the well to perform at an optimum level.

As shown in FIG. 1, the bottom hole assembly 20 is disposed on production tubing extending from surface equipment 60. As schematically shown here, the bottom hole assembly 20 includes production equipment 30 including the packer 16, a snorkel or riser tube for the bypass 40, the production port 34, and the gas lift valve 100. The packer 16 seals off the annulus 14 in the casing 12/liner 15, as the case may be. The snorkel tube 40 extends from the production equipment 30 to communicate the equipment's throughbore 32 with the annulus 14 uphole of the packer 16. The production port 34 and the gas lift valve 100 also communicate the equipment's throughbore 32 with the annulus 14.

Once set, the packer 16 and production equipment 30 remains downhole while other components of the completion 10 are transitioned to configure the completion for different forms of artificial lift. For example, the production equipment 30 of the bottom hole assembly 20 is configurable for different forms of lift operations depending on the needs of the well. Communication via the various snorkel tube 40, the production port 34, and the gas lift valve 100 between the throughbore 32 and the annulus 14 depends on the particular configuration of lift equipment (not shown) disposed in the equipment's throughbore 32.

Further details of the lift equipment (not shown) and configurations of the production equipment 30 are provided below. For its part, various types of surface equipment 60 connected to the production equipment 30 can be interchanged at surface as suited for the lift equipment (not shown) configured for the different forms of artificial lift. For example, the surface equipment 60 can include a pump jack for reciprocating rod lift, a lubricator for plunger lift, a gas injection system for gas lift, and a hydraulic system for hydraulic lift.

In general, the production equipment 30 can include an integrated component combining one or more of the packer 16, the snorkel tube 40, the production port 34, the gas lift valve 100, and other related elements together. Alternatively, the production equipment 30 can comprise a number of interconnected components. For example, FIG. 2 illustrates one configuration of the production equipment 30 of the present disclosure having interconnected components. Any number of tubing joints 31*a*, 31*c*, 31*f*, and the like can be used to space out components of the production equipment 30. The gas lift valve 100 can be integrated into a gas lift mandrel 31*b*, the production port 34 can be integrated into a sliding sleeve or tubular housing 31*d*, the snorkel tube 40 can be integrated into a tubular housing 31*e*, and the packer 16 can be integrated into a compression packer housing 31*g*—each of which can be interconnected together with the tubing joints to construct the production equipment 30. Of course, any one or more of these components can be integrated together.

Figure 3:
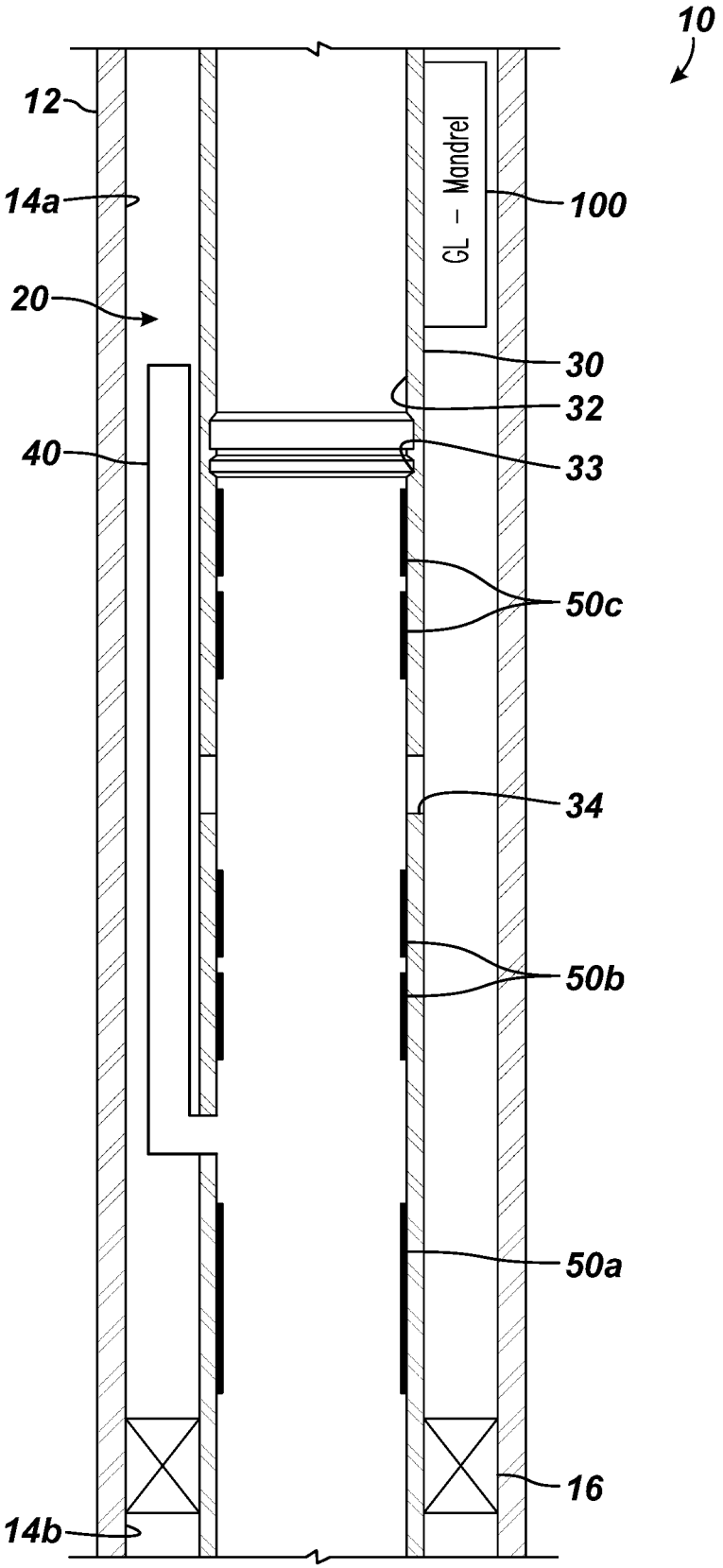
FIG. 3 illustrates portion of the completion showing the bottom hole assembly according to the present disclosure in more detail.

With a general understanding of the completion 10, the bottom hole assembly 20, and the production equipment 30, FIG. 3 illustrates portion of the completion 10 showing the bottom hole assembly 20 according to the present disclosure in more detail. As before, the completion 10 includes the casing 12 (or liner 15) for the well. The bottom hole packer 16 seals the annulus 14 of the casing 12 (or liner 15) with the production equipment 30 disposed in the casing 12.

The production equipment 30 includes the throughbore 32 having one or more production ports 34 communicating with the annulus 14. The production equipment 30 includes the snorkel tube 40 that extends uphole in the annulus 14 from the throughbore 32. A plurality of internal bore seals 50*a-c* are disposed in the throughbore 32 relative to the one or more ports 34 and the bypass (e.g., snorkel tube 40). In particular, a first (lower) bore seal 50*a* is disposed in the throughbore 32 downhole of the snorkel tube 40, a second (intermediate) bore seal 50*b* is disposed between the snorkel tube 40 and the ports 34, and a third (upper) bore seal 50*c* is disposed uphole of the ports 34.

The longitudinal distances between the bore seals 50*a-c* will depend on the particular implementation, diameter of the wellbore, diameter of the production tubing, the size of lift equipment to be disposed therein, etc. As one example for casing 12 having a diameter of 5½-in. and the equipment 30 having a diameter of 2⅞-in., the upper bore seals 50*b-c* can be spaced to accommodate lift equipment, such as a 2-ft. hydraulic jet pump and a 7-ft. hydraulic piston pump. As will be appreciated, the dimensions of the downhole assembly 20 can be suited for the particular needs of an implementation.

As depicted, the production equipment 30 can be integrated tubing having the above features form as part of it. Alternatively and as is common, the production equipment 30 can include a plurality of interconnected housings, components, tubulars, and the like properly connected together to produce a tubular body. Accordingly, any conventional arrangement of elements can be combined together to facilitate manufacture and assembly of the production equipment 30.

Figure 5A:
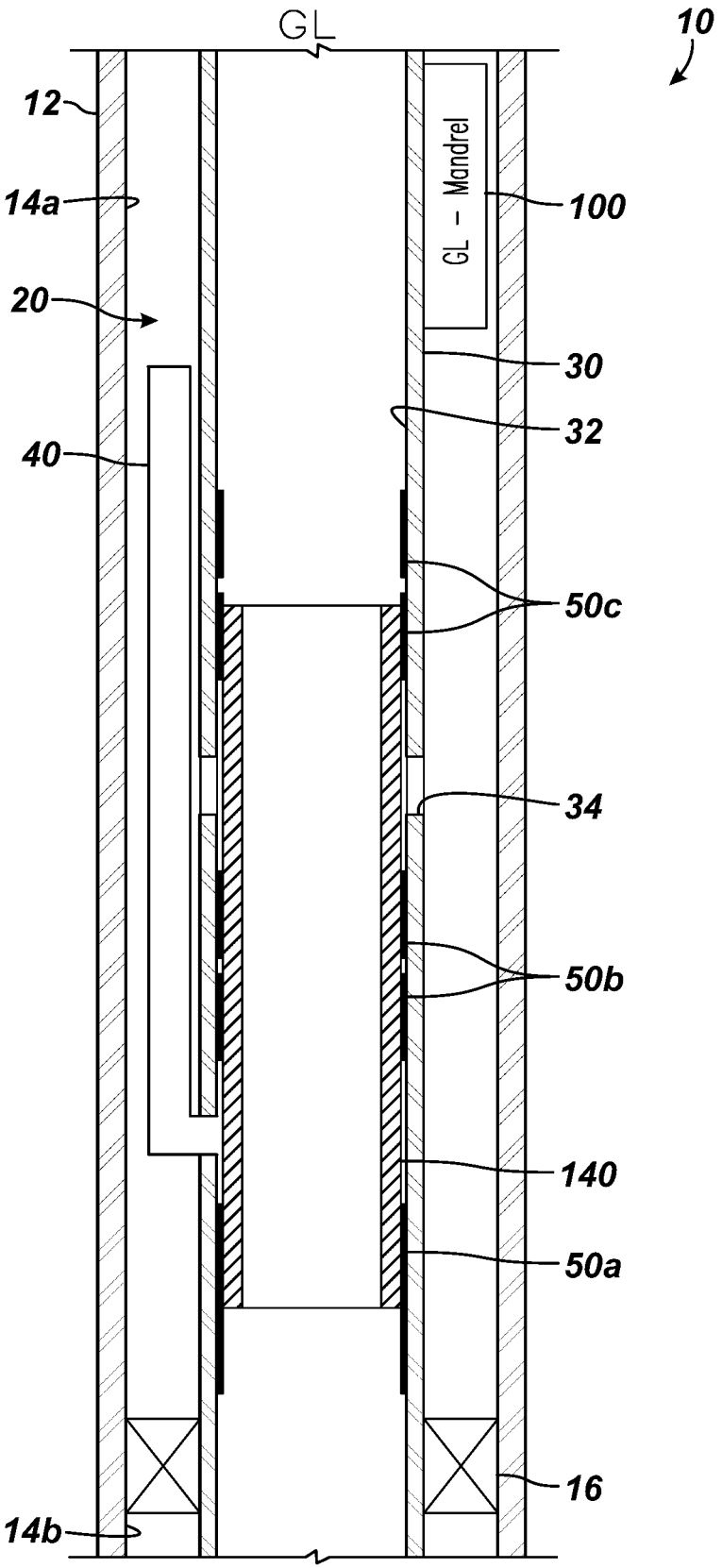
FIG. 5A illustrates the bottom hole assembly configured for gas lift.

The bore seals 50*a-c* can include polished bores for engaging seals of lift equipment (not shown) inserted therein. In some implementations, the bore seals 50*a-c* may include seal rings, nipples, latch profiles, seats, and the like for engaging the lift equipment (not shown) removably inserted in the equipment's throughbore 32. As one example, a profile 33, such as an X-lock profile, may be provided in the throughbore 32 to lock a sleeve, a plug, a component of the disclosed equipment, or the like in place. For example, the profile 33 can be used to lock a sleeve (140: FIG. 5A) in place during a gas lift operation. This and other forms of nipple and lock profiles can be provided in the throughbore 32 as desired.

At the uphole end, the production equipment 30 includes the gas lift valve 100. Typically, the gas lift valve 100 can be an external valve positioned on a tubing mandrel for controlling communication from the annulus 14 into the tubing mandrel, which communicates with throughbore 32. Such an external gas lift valve 100 can be installed at surface and run downhole with the production equipment 30. As an alternative, a side pocket mandrel can be disposed on the production equipment 30 and can hold a removable gas lift valve 100 therein. These and other forms of gas lift valves 100 can be used. Moreover, although only one gas lift valve 100 is shown, a given implementation may have multiple gas lift valves 100 along the production equipment 30.

Figure 4A:
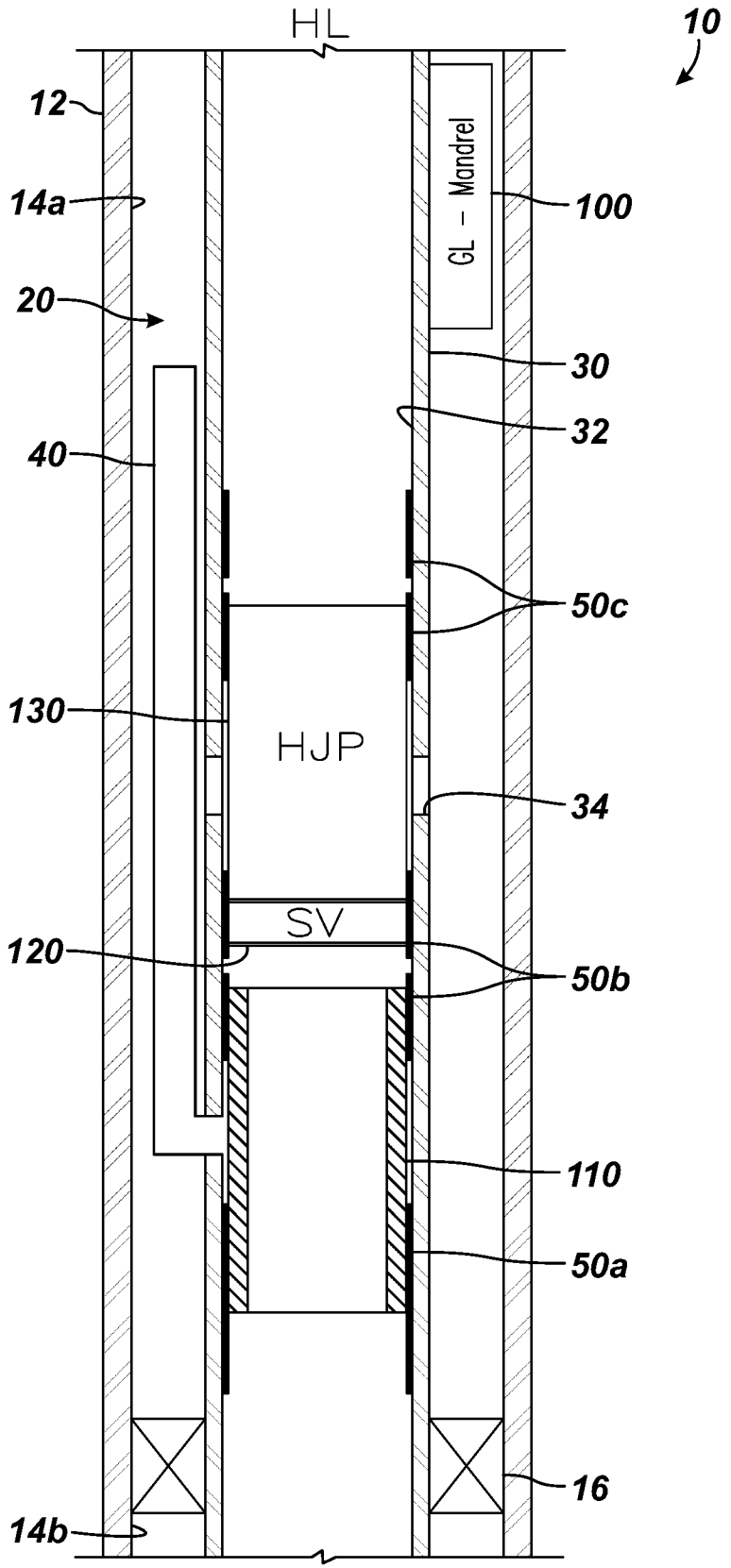
FIG. 4A illustrates the bottom hole assembly configured for hydraulic lift using a hydraulic jet pump.

According to the present disclosure, the production equipment 30 can be configured for hydraulic lift using a hydraulic jet pump (HJP). For example, FIG. 4A illustrates portion of the completion 10 with the bottom hole assembly 20 configured for hydraulic lift using a hydraulic jet pump 130. Using conventional running techniques, such as wireline, slickline, coiled tubing, or the like, lift equipment 110, 120, and 130 has been run into position in the bottom hole assembly 20.

The lift equipment includes isolation 110 that selectively prevents and allows communication via one or both of the production port 34 and the bypass (snorkel tube 40). In particular, an isolation sleeve 110 is inserted in the throughbore 32 and seals with the lower and intermediate bore seals 50*a-b* to seal off communication of the throughbore 32 with the snorkel tube 40. The isolation sleeve 110 can include external seals or surfaces for sealing with the bore seals 50*a-b*. To run the sleeve 100 into place, the sleeve 100 can have profiles or other features for running with wireline or the like.

The lift equipment includes a standing valve 120 installed uphole of the isolation sleeve 110 to seal with the intermediate bore seal 50*b*, and includes the hydraulic jet pump 130 installed uphole of the standing valve 120 to seal with the upper bore seal 50*c*. The standing valve 120 can be installed on the hydraulic jet pump 130 and can be run in with it. Additionally, the isolation sleeve 110 can be run in place together with the other components of the standing valve 120 and pump 130 as a unit.

Finally, the gas lift valve 100 can be already installed as part of the bottom hole assembly 20. Alternatively, should the valve 100 be removable in a side pocket mandrel, either the valve 100 is installed in the side pocket, or a dummy valve or blank is installed for simply closing off fluid communication.

Figure 4B:
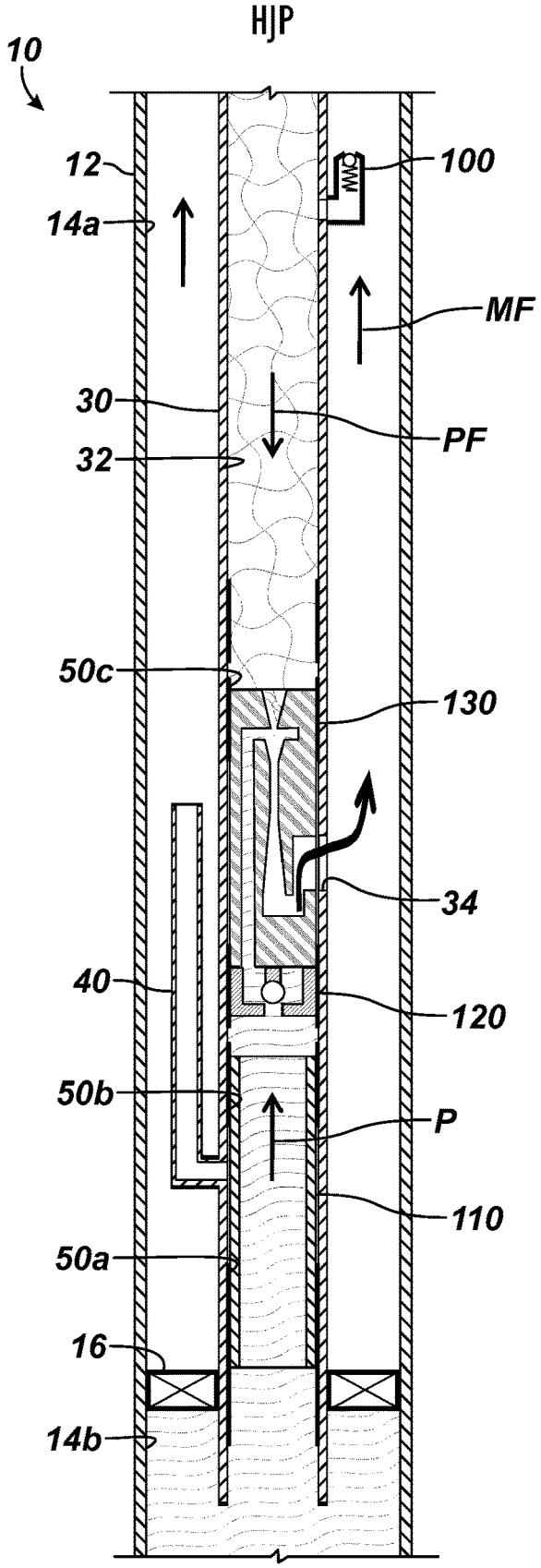
FIG. 4B illustrates the assembly of FIG. 4A in more detail.

During the hydraulic lift operation as best shown in FIG. 4B, surface equipment (60) including power fluid storage, a pump, flow controls, and the like pumps a power fluid PF downhole to the throughbore 32 of the production equipment 30. In general, the force of the power fluid PF against the hydraulic jet pump 130 can hold the pump 130 in place in the bore seals 50*b-c* of the throughbore 32. Meanwhile, production P isolated downhole in the lower annulus 14*b* can flow up through the throughbore 32 past the standing valve 120, while the isolation sleeve 110 isolates the production P from the snorkel tube 40.

Figure 4C:
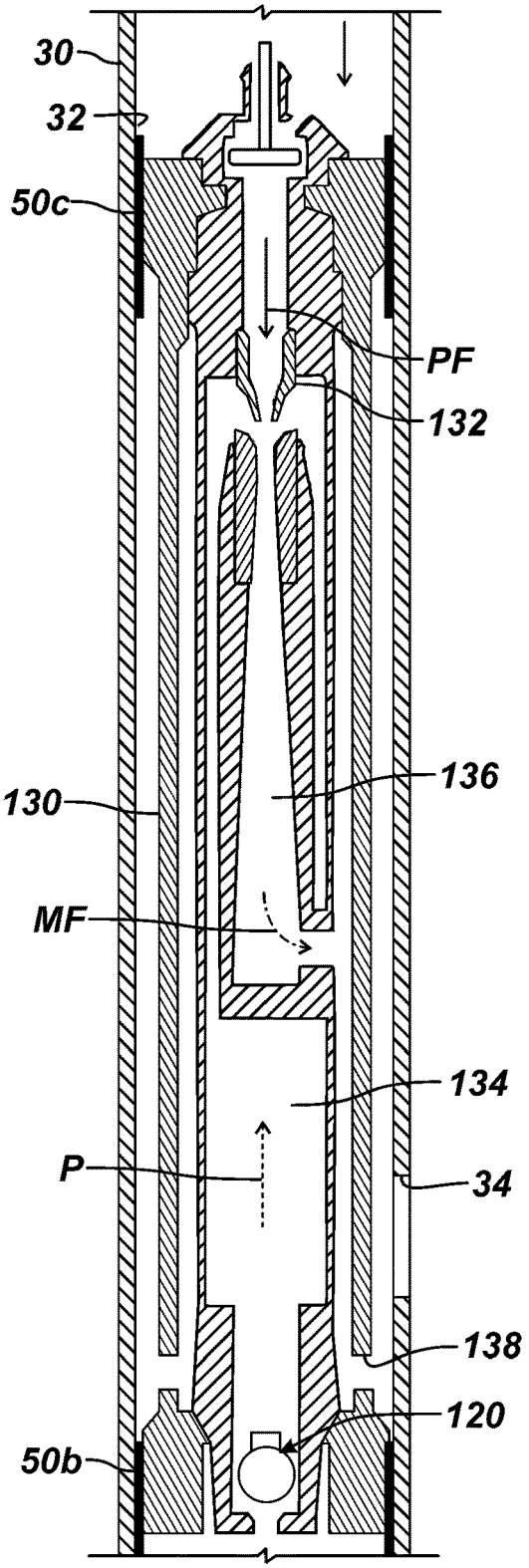
FIG. 4C illustrates the hydraulic jet pump of FIG. 4B in more detail.

At the hydraulic jet pump 130 (shown in detail in FIG. 4C) disposed in the throughbore 32 at the production port 34, the power fluid PF enters an inlet nozzle 132 as the production P passing the standing valve 120 enters an inlet 134. The two fluids mix at the nozzle 132, and the mixed fluid MF collected in the mixing chamber 136 passes out the pump's outlet 138 sealed in communication with the equipment's production port 34. At this point, the mixed fluid MF of power fluid and production can pass up the uphole annulus 14*a* to the surface equipment (60).

At the same time, the gas lift valve 100, which operates as a check valve, prevents the power fluid PF in the throughbore 32 from passing to the uphole annulus 14*a*. The mixed fluid in the uphole annulus 14*a* is at a lower pressure than the power fluid PF so the gas lift valve 100 remains closed. For its part, the standing valve 120 prevents escape of production fluid from the hydraulic jet pump 130 downhole in the absence of sufficient fluid level.

In the previous arrangement, the jet pump 130 operated with the power fluid PF communicated from uphole down the throughbore 32 so that the mixed fluid MF traveled up the annulus 14*a*. A reverse operation can also be used. In particular, the jet pump 130 can be installed in the throughbore 32, and power fluid PF can be communicated from uphole down the annulus 14*a* where it can the enter the jet pump 130 through the port 34. As before, production P rising up the throughbore 32 from downhole also enters the jet pump 130 and the two fluids mix therein. Finally, the mixed fluid MF then travels uphole to surface through the throughbore 32.

For this arrangement, it may be desirable to have a lock profile (see e.g., profile 33 in FIG. 3) to help retain the jet pump 130 sealed in the bore seals 50*b-c* of the throughbore 32. Corresponding lock dogs (not shown) on the jet pump 130 can operably engage the profile (33) to hold the jet pump 130 in place. The lock dogs can be operated using conventional wireline running procedures or the like. If the jet pump 130 does not have such lock dogs, then some other holddown flow component disposed uphole of the jet pump 130 can have the dogs.

For the arrangement in which the power fluid is communicated down the annulus 14*a*, modifications may be necessary given the presence of the one or more gas lift valves 100 of the assembly 20. A number of options are available. For example, the one or more gas lift valves 100, which may take the form of insertable gas lift valves installing in side pocket mandrels, may be replaced with dummy valves to prevent communication of power fluid in the annulus 14*a* to the throughbore 32.

In another option, each of the gas lift mandrels having an integrated gas lift valve 100 (as in FIG. 5C for example) may have a nipple profile in its bore for independent placement of an isolation sleeve 110 to isolate fluid communication between the annulus 14*a* and the throughbore 32. Should there be more than one integrated gas lift valve 100 on the production equipment 30, these independent isolation sleeves 110 can be installed successively uphole in separate running procedures after installing the jet pump 130 and its isolation sleeve 110 downhole. Finally, even if an integrated gas lift valve 100 is used on the production equipment 30, the pressure control provided by the valve 100 may be configured so that the power fluid communicated down the annulus 14*a* does not pass through the valve 100 to the throughbore 32.

According to the present disclosure, the production equipment 30 can be configured for gas lift. For example, FIG. 5A illustrates portion of the completion 10 with the bottom hole assembly 20 configured for gas lift. Using conventional running techniques, such as wireline or the like, any previous equipment disposed in the assembly 20 can be removed, and lift equipment 140 has been run into position in the bottom hole assembly 20. In particular, isolation in the form of a second isolation sleeve 140 is disposed in the throughbore 32 and seals with the bore seals 50*a-c* to seal off communication of the throughbore 32 with the snorkel tube 40 and the production port 34.

The isolation sleeve 140 can include external seals or surfaces for sealing with the bore seals 50*a-c*. To run the sleeve 140 into place, the sleeve 140 can have profiles or other features for running in with wireline or the like. As shown, this second sleeve 140 can be an elongated sleeve to replace any shorter first sleeve (110) used in other configurations. As an alternative, of course, any shorter first sleeve (110) can remain in place to seal off the snorkel tube 40, and another shorter second sleeve can be run in place to seal off the production ports 34.

Finally, the gas lift valve 100 can be already installed as part of the bottom hole assembly 20. Alternatively, should the valve 100 be removable in a side pocket mandrel, the valve 100 can be installed in the side pocket. Any other suitable type of gas lift valve 100 can be used to fit the particular implementation.

As an aside, the assembly 20 configured as in FIG. 5A with the production port 34 and snorkel tube 40 isolated can likewise operate for normal production, if possible from the formation. Accordingly, the configuration of the assembly 20 in FIG. 5A can be used at the start of the assembly's use during normal production or in a circumstance where artificial lift is not needed. The use of the configuration for normal production can be possible regardless of whether the one or more gas lift valves 100 are present or not.

Figure 5B:
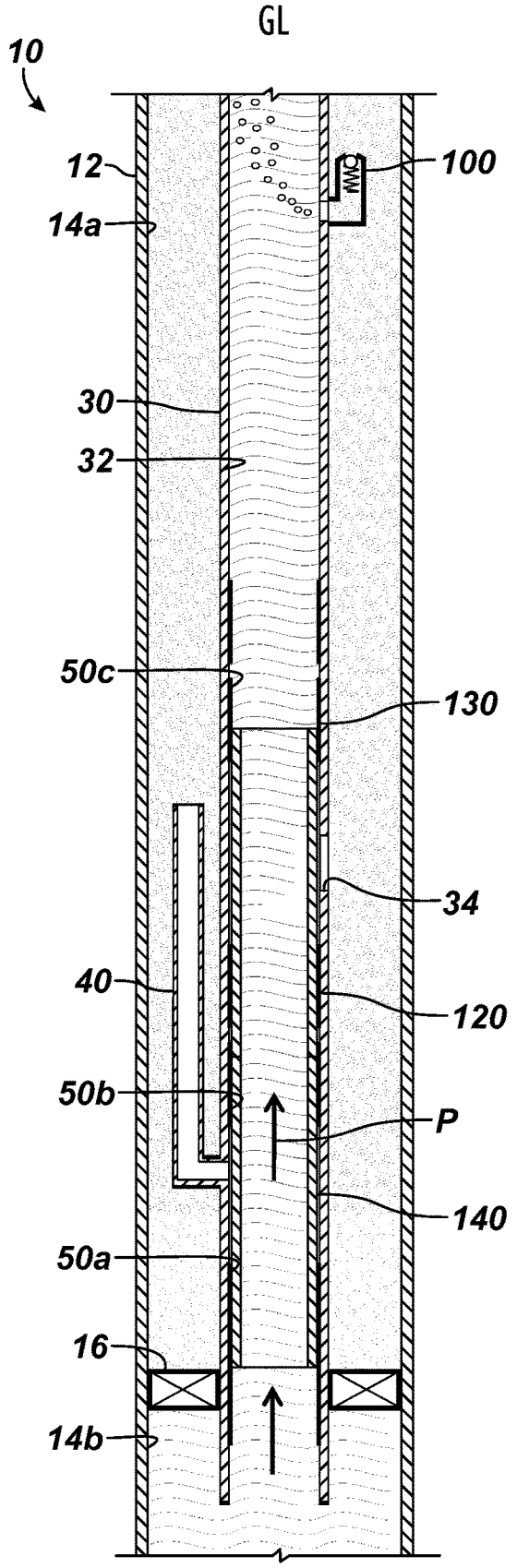
FIG. 5B illustrates the assembly of FIG. 5A in more detail.
Figure 5C:
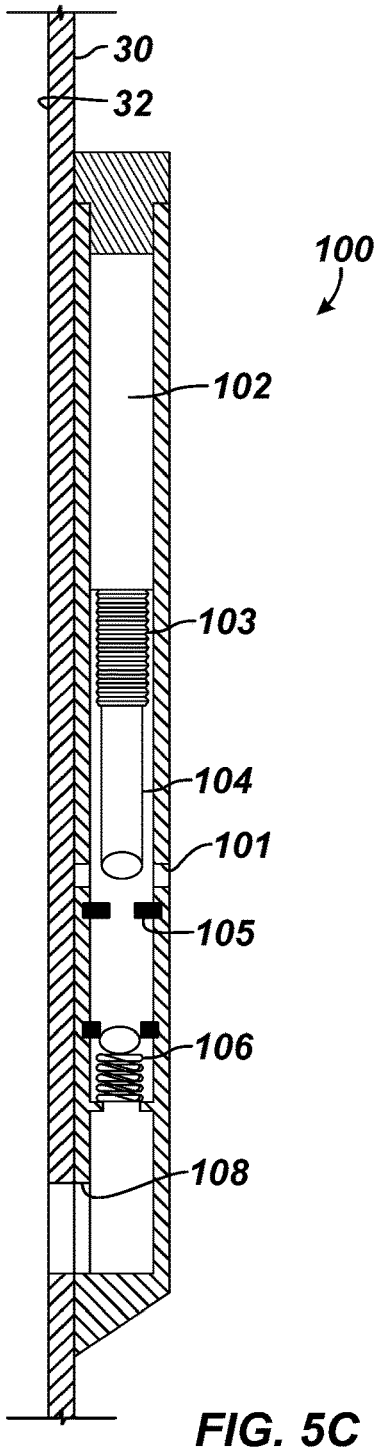
FIG. 5C illustrates the gas lift valve of FIG. 5B in more detail.

During the gas lift operation as best shown in FIG. 5B, surface equipment (60) including gas storage, a compressor, flow controls, and the like pumps a gas G downhole through the uphole annulus 14*a* outside the production equipment 30. Meanwhile, production P isolated downhole in the lower annulus 14*b* can flow up through the throughbore 32. The isolation sleeve 140 isolates the production P from the snorkel tube 40 and the production port 34.

At the gas lift valve 100 (shown in detail in FIG. 5C), the gas G enters an inlet 101 and can pass through a seat 105 based on the control of a pressure-sensitive valve 104. In general, the pressure-sensitive valve 104 holds a dome pressure 102 that is kept separate from the inlet pressure by a baffle 103, and the differential pressure controls the position of the valve 104 relative to the seat 105. Passing this pressure control, the gas passes a check valve 106 to flow out an outlet 108 into the equipment's throughbore 32. At this point, the entering gas assists the production to pass up the throughbore 32 to the surface equipment (60).

Figure 6A:
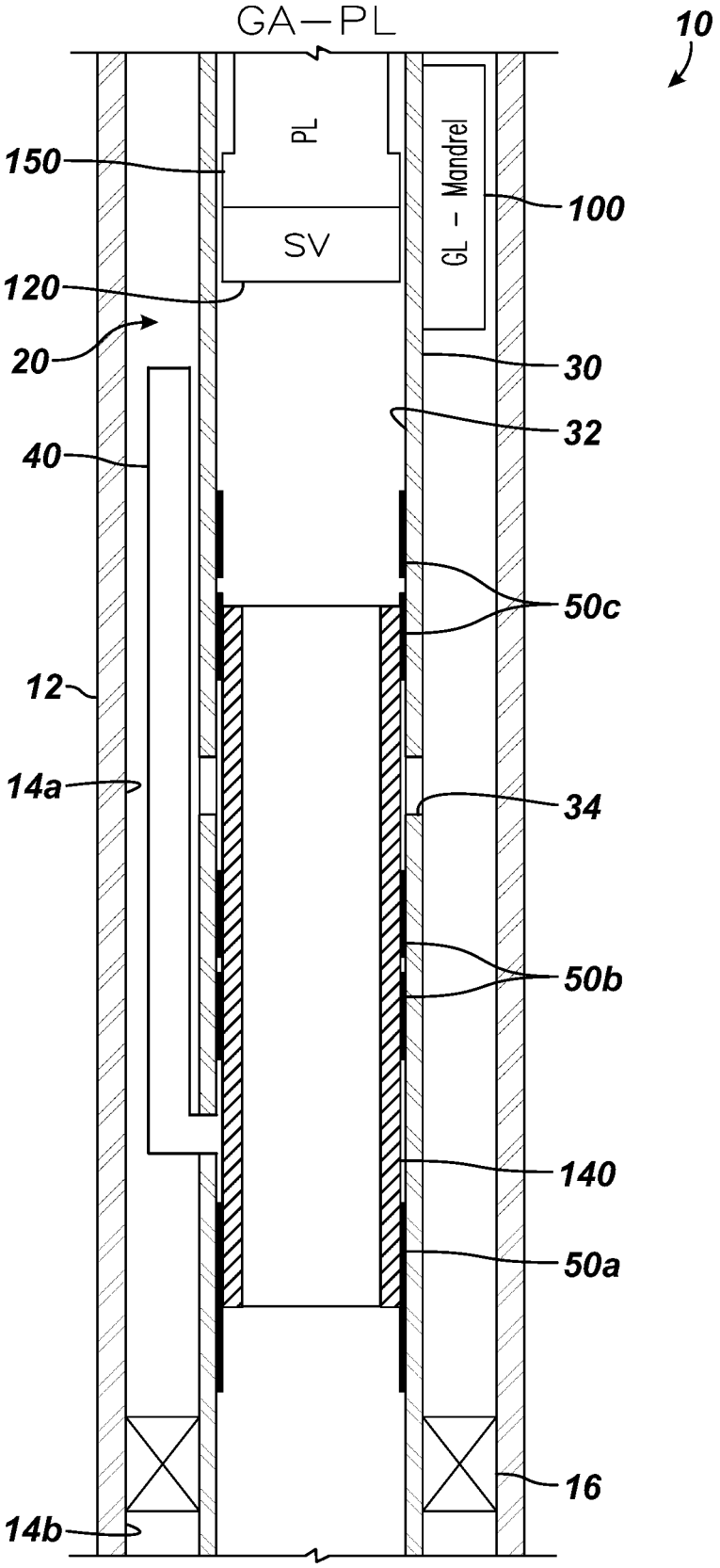
FIG. 6A illustrates the bottom hole assembly configured for gas-assisted plunger lift.
Figure 6B:
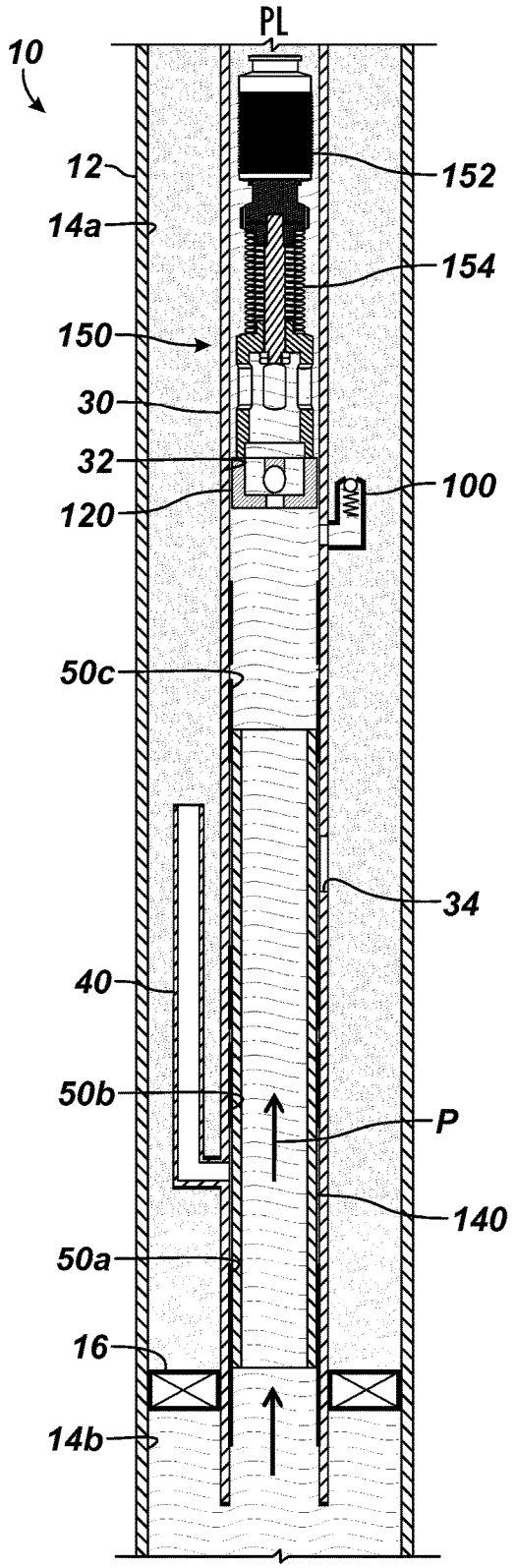
FIG. 6B illustrates the assembly of FIG. 6A in more detail.

According to the present disclosure, the production equipment 30 can be configured for plunger lift as well as gas-assisted plunger lift. For example, FIG. 6A illustrates portion of the completion 10 with the bottom hole assembly 20 configured for gas-assisted plunger lift (GA-PL). With the assembly 20 configured as before in FIG. 5A, a standing valve 120 and a plunger lift bumper spring assembly 150 are run into the production equipment 30 adjacent the gas lift valve 100. The plunger lift system 150 has a plunger 152 and a bottom hole bumper 154 positioned in production equipment 30 within the casing 12, as shown in FIG. 6B. At the wellhead, the system 150 has a lubricator/catcher 156 and controller 158, as shown in FIG. 6C.

Figure 6C:
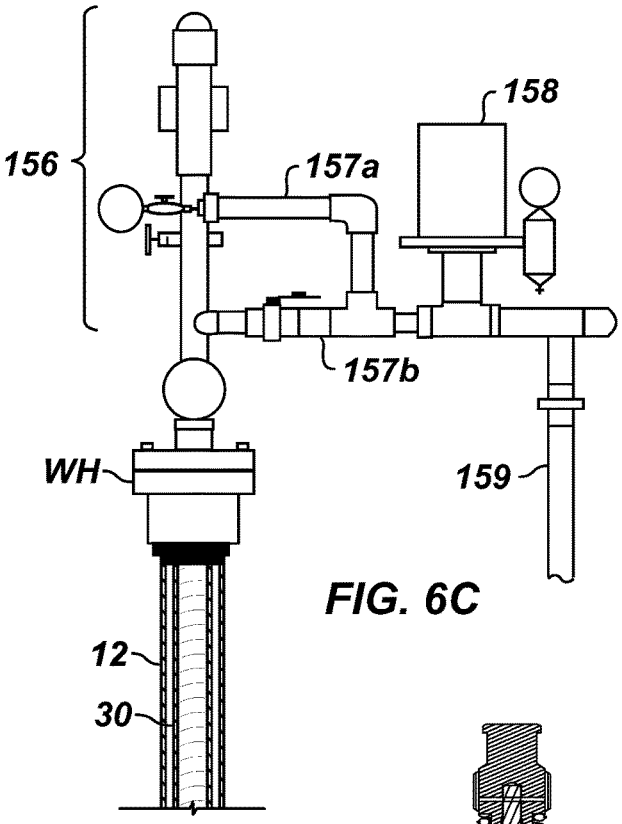
FIG. 6C illustrates surface equipment for the assembly of FIG. 6B.

During the plunger lift operation as best shown in FIGS. 6B-6C, surface equipment including a lubricator 156, catch (not shown), bypass piping, and controller 158 deploys the plunger 152 in the throughbore 32 of the production equipment 30. Meanwhile, production P isolated downhole in the lower annulus 14*b* can flow up through the throughbore 32, while the isolation sleeve 140 isolates the production P from the snorkel tube 40 and the production port 34.

The plunger 152 initially rests on the bottomhole bumper 154 at the base of the production equipment 30. Typically, the production P includes gas, oil, and water and lacks sufficient pressure to rise to the surface. Therefore, gas is produced at surface while the deployed plunger 152 rests at the bumper 154 above a standing valve 120, which prevents escape of fluid. As the gas is produced to a sales line 159, liquids may accumulate in the throughbore 32, creating back-pressure that can slow gas production through the sales line 159. Using sensors (not shown), the controller 158 operates a valve at the wellhead to regulate the buildup of gas in the production equipment 30.

Sensing the slowing gas production, the controller 158 shuts-in the well at the wellhead to increase pressure in the well as high-pressure gas accumulates in the throughbore 32. When a sufficient volume of gas and pressure are reached, the gas pushes the plunger 152 and the liquid load above it to the surface so that the plunger 152 essentially acts as a piston between liquid and gas in the production tubing.

Eventually, the gas pressure buildup pushes the plunger 152 upward to the lubricator/catcher 156 at the wellhead. The column of fluid above the moving plunger 152 likewise moves up the tubing to the wellhead so that the liquid load can be removed from the well. As the plunger 152 rises, for example, the controller 158 allows gas and accumulated liquids above the plunger 152 to flow through upper and lower outlets 157*a-b*. The lubricator/catcher 156 eventually captures the plunger 152 when it arrives at the surface, and the gas that lifted the plunger 152 flows through the lower outlet 157*b* to the sales line 159. Once the gas flow stabilizes, the controller 158 again shuts-in the well and releases the plunger 152, which drops back downhole to the bumper 154. Ultimately, the cycle repeats itself.

The plunger 152 may cycle normally without gas assistance. However, gas assist can be provided from the upper annulus 14*a* if needed through the gas lift valve 100. Accordingly, the surface equipment at the lubricator 156 can include a gas injection system for injecting gas into the annulus 14*a* for entry into the throughbore 32 through the gas lift valve 100. This injected gas in the throughbore 32 can assist with the cycling of the plunger 152. As depicted in FIG. 6B, injected gas can enter the throughbore 32 via the gas lift valve 100 so as to be below the lower travel limit of the plunger 152. In fact, the injected gas may communicate into the throughbore 32 below the bumper 154. Either way, gas can be built up downhole of the plunger 152 for eventually pushing the plunger 152 uphole.

As shown, the plunger 152 can have a solid or semi-hollow body, and the plunger 152 can have spirals, fixed brushes, pads, or the like on the outside of the body for engaging the tubing. Any other suitable type of plunger lift assembly 150 can be used to fit the particular implementation. For example, a two piece plunger can be used, or plungers with different external sealing profiles can be used. The bumper 154 can be integrated with the standing valve 120.

Figure 6D:
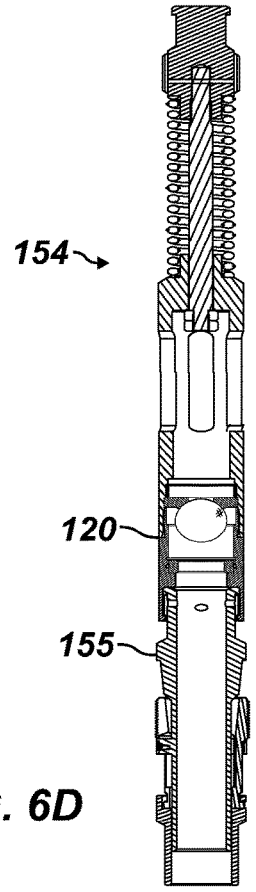
FIG. 6D illustrates an alternative configuration of bumper, standing valve, and tubing stop of the assembly in FIG. 6B.

Depending on the bore seal, any latch profiles, or seats provided in the throughbore 32, the bumper 154 can install in the throughbore 32 with conventional components. Briefly, the bumper 154 can install in the production equipment 30 using wireline procedures. As shown in the example of FIG. 6D, the bumper 154 can have a biased bumper rod supported on a tubing stop 155 that engages in the throughbore. The bumper 154 can also have a standing valve 120 incorporated herein, although the standing valve can be supported separately on another tubing stop or can be supported in another way further down the throughbore 32.

Figure 7A:
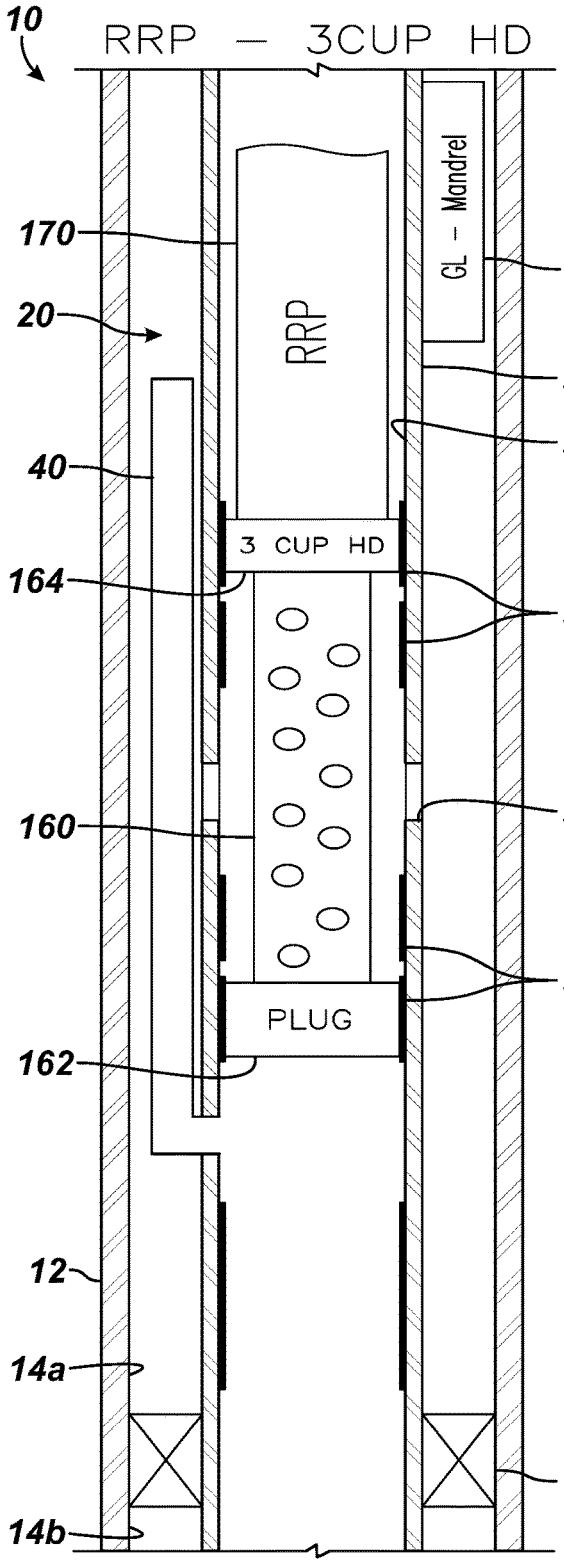
FIG. 7A illustrates the bottom hole assembly configured in one configuration for mechanical lift using a reciprocating rod pump.

According to the present disclosure, the production equipment 30 can be configured for mechanical lift using a reciprocating rod pump (RRP). For example, FIG. 7A illustrates portion of the completion 10 with the bottom hole assembly 20 configured in one configuration for lift using a reciprocating rod pump 170. Using conventional running techniques, such as wireline or the like, any previous equipment disposed in the assembly 20 can be removed, and additional lift equipment 160, 162, 164, and 170 has been run into position in the bottom hole assembly 20.

In general, isolation allows the communication via the production ports 34 and the snorkel tube 40, but separates them. In particular, a perforated subcomponent, permeable conduit, screen, or the like 160 has a plug 162 at its lower end and has a holddown 164 at its uphole end. The perforated sub 160 extends from the reciprocating rod pump 170 disposed uphole in the production equipment 30. The plug 162 seals with the intermediate bore seal 50*b*, and the holddown 164 seals with the upper bore seal 50*c*. Accordingly, the perforated sub 160 communicates with the production ports 34.

Meanwhile, the snorkel tube 40 communicates the upper annulus 14*a* with the throughbore 32 downhole of the plug 162, and the upper annulus 14*a* communicates with the production port 34 for delivery to the reciprocating rod pump 170. In this way, production fluid downhole of the packer 16 can collect in the upper annulus 14*a*. The snorkel tube 40 helps to separate gas and liquid in the production fluid so the liquid will tend to collect in the lower part of the annulus 14*a*, while the gas collects further uphole, where it can be removed at surface.

Finally, the gas lift valve 100 can be already installed as part of the bottom hole assembly 20. Alternatively, should the valve 100 be removable in a side pocket mandrel, either the valve 100 is installed in the side pocket, or a dummy valve or blank is installed for simply closing off fluid communication.

The jet pump and gas lift operations discussed previously in FIGS. 4A and 5A can work sufficiently with the packer 16 set to isolate the annulus 14. The gas-assisted plunger lift in FIG. 6A also benefits from the packer 16 to prevent pressure bypass. Eventually, most wells end up requiring mechanical lift with a rod pump. However, most unconventional wells have a high gas-to-liquid ratio, and the free gas will reduce the rod pump's efficiency. Accordingly, the production equipment 30 of FIG. 7A provides downhole gas separation. Additionally, a separate gas flow path is provided to surface via the annulus 14*a* and is handled by surface equipment (60).

In the present embodiment, the snorkel tube 40 is the form of bypass that provides the downhole gas separation for the rod pump 170. Production is diverted into the snorkel tube 40 above the packer 16. Fluids exiting the tube 40 separate in the annulus 14*a* with the gases rising and the liquids fallings. The liquids then reenter the throughbore 32 through the production port 34 and flow past the standing valve 120 to the pump's intake.

Figure 7E:
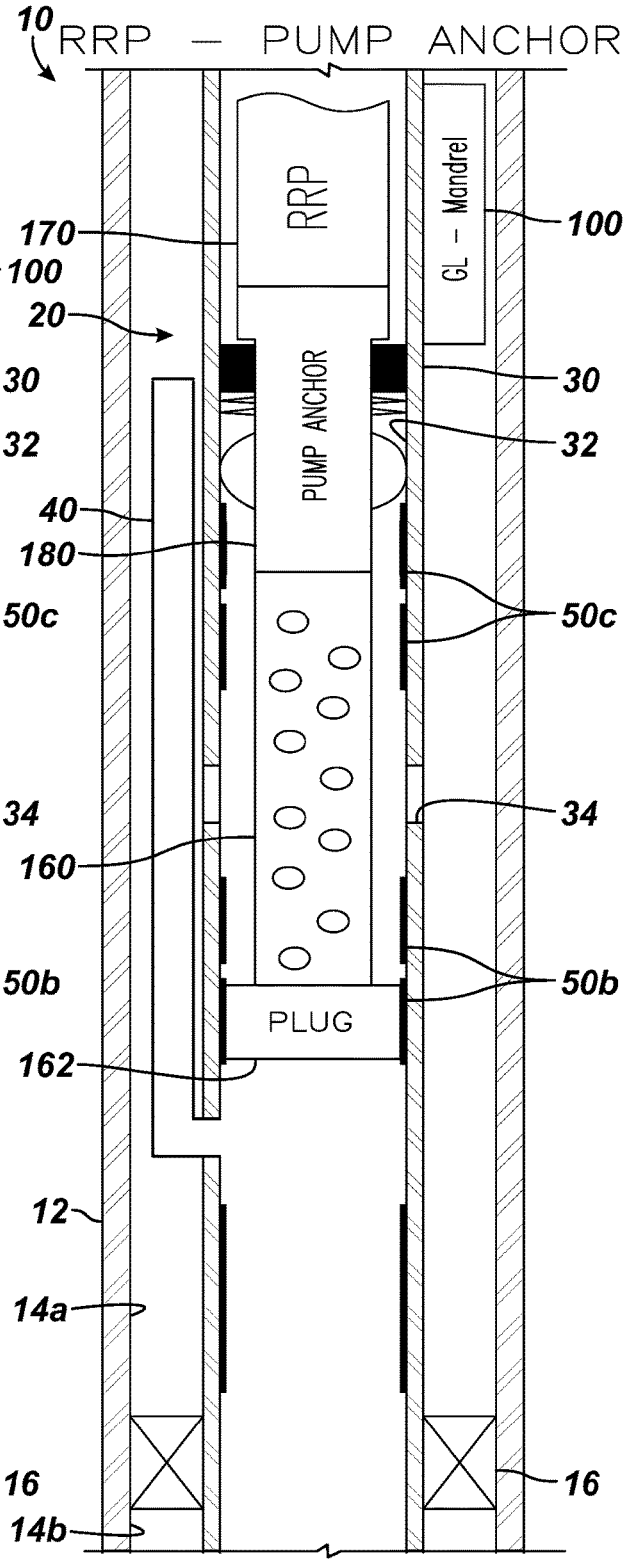
FIG. 7E illustrates the bottom hole assembly configured in another configuration for mechanical lift using a reciprocating rod pump.

Other bypass components could be used to separate gas and liquid in place of (or in addition to) the snorkel tube 40. For example, a concentric arrangement having inner and outer tubulars, such as shown in FIG. 7D, can be used as a downhole gas separator. Production passes up a concentric annulus and out of upper slots into the tubing annulus 14*a*. Gases flow uphole, while liquids flow downhole to reenter the production port 34. As will be appreciated, these and other forms of bypass can be used for downhole gas separation.

Figure 7B:
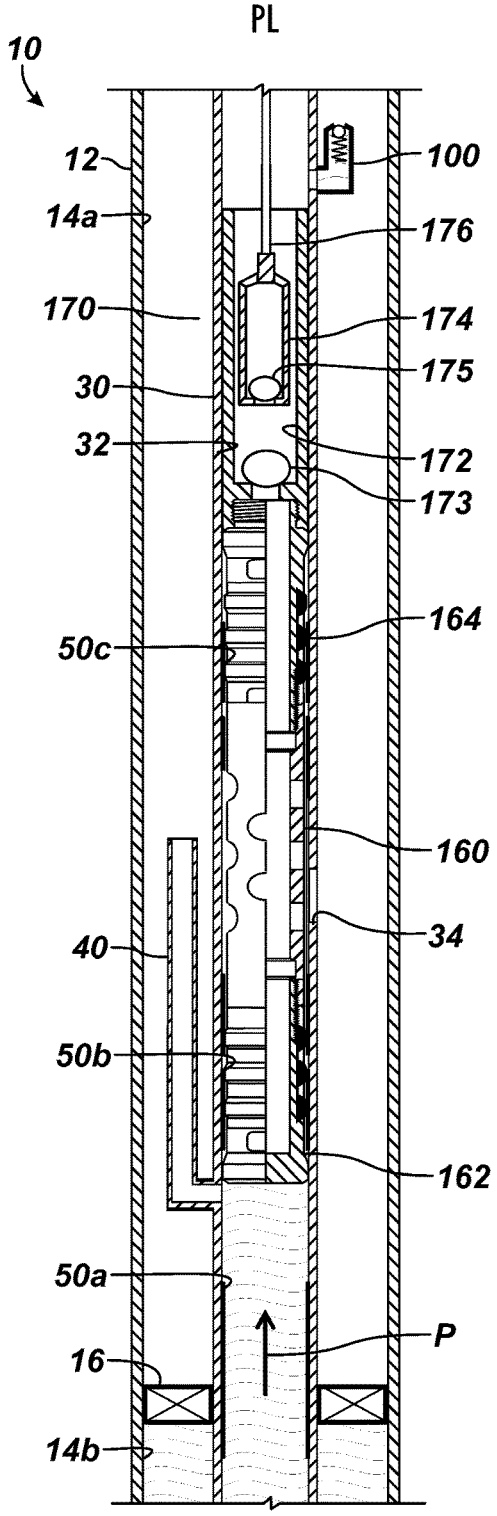
FIG. 7B illustrates the assembly of FIG. 7A in more detail.
Figure 7C:
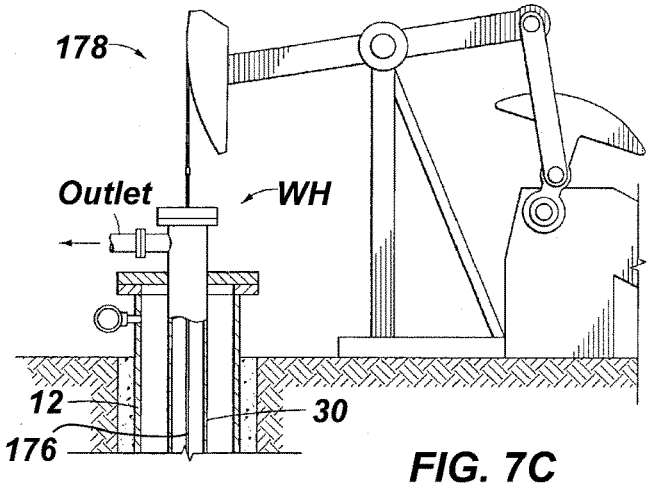
FIG. 7C illustrates surface equipment for the assembly of FIG. 7A.
Figure 7D:
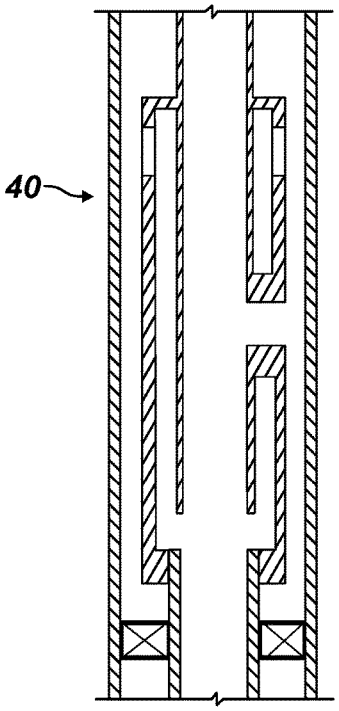
FIG. 7D illustrates an alternative bypass for downhole gas separation according to the present disclosure.

As shown in FIGS. 7B and 7C, the reciprocating rod pump 170 includes a barrel 172 having a standing valve 173 and includes a plunger 174 having a traveling valve 175. During the pump lift operation, production fluid passing up the throughbore 32 escapes into the uphole annulus 14*a* through the snorkel tube 40. Gas in the fluid tends to rise up the annulus 14*a*, where it can be handled at the wellhead WH by surface equipment. Liquid in the production fluid collects in the annulus 14*a* above the packer 16, where it can enter the production port 34, pass through the perforated sub 160, and go into the pump's inlet.

Meanwhile, reciprocal movement of a string 176 of sucker rods induces reciprocal movement of the plunger 174 for lifting production fluid to the surface. Reciprocated by rod string 176 from the surface pumping unit 178, such as a pump jack, the plunger 174 with its traveling valve 175 lifts a column of production fluid up the throughbore 32, while the standing valve 173 maintains entering production fluid in the barrel 172 in which the pump 174 reciprocates. The standing and traveling valves 173 and 175 can each be a check valve (i.e., one-way valve) having a ball and seat.

As the surface pumping unit 178 reciprocates, for example, the rod string 176 reciprocates in the production tubing 30 and moves the plunger 174. The plunger 174 moves the traveling valve 175 in reciprocating upstrokes and downstrokes. During an upstroke, the traveling valve 175 closed. Movement of the closed traveling valve 175 upward reduces the static pressure within a pump chamber (the volume between the standing valve 173 and the traveling valve 175 that serves as a path of fluid transfer during the pumping operation). This, in turn, causes the standing valve 173 to open so that the lower ball lifts off the lower seat. Production fluid P is then drawn upward into the chamber.

On the following downstroke, the standing valve 173 closes as the standing ball seats upon the lower seat. At the same time, the traveling valve 175 opens so fluids previously residing in the chamber can pass through the valve 175 and into the plunger 174. Ultimately, the produced fluid P is delivered by positive displacement of the plunger 174 into the barrel 172. The moved fluid then moves up the wellbore production equipment 30. The upstroke and downstroke cycles are repeated, causing fluids to be lifted upward through the wellbore. To convey the fluid, production tubing 30 extends from a wellhead WH downhole. At the surface, the wellhead WH receives production fluid and diverts it to a flow line outlet.

FIG. 7E illustrates the completion 10 with the bottom hole assembly 20 configured in another configuration for lift using the reciprocating rod pump 170. The arrangement in FIG. 7E is similar to that disclosed above with reference to FIG. 7A. Instead of using a holddown as before, this configuration uses a pump anchor 180 from which the perforated sub 160 extends. As shown, the pump anchor 180 anchors in the throughbore 32 away from the bore seals 50*c* and can include anchor slips, a packing element, and the like, which can be set using conventional techniques.

Figure 8A:
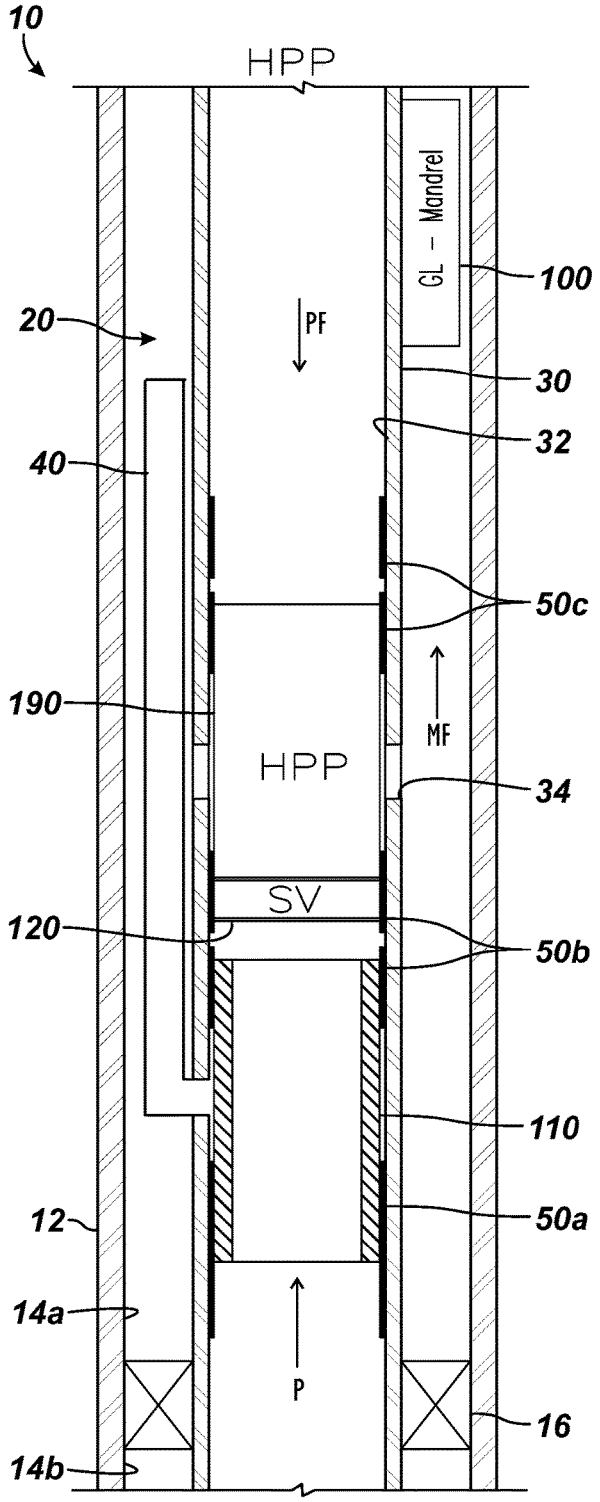
FIG. 8A illustrates the bottom hole assembly configured in one configuration for hydraulic lift using a hydraulic piston pump.

According to the present disclosure, the production equipment 30 can be configured for hydraulic lift using hydraulic piston pump (HPP). For example, FIG. 8A illustrates portion of the completion 10 with the bottom hole assembly 20 configured in one configuration for lift using a hydraulic piston pump 190. Using conventional running techniques, such as wireline or the like, any previous equipment disposed in the assembly 20 can be removed, and additional lift equipment 110, 120, and 190 has been run into position in the bottom hole assembly 20.

In particular, isolation in the form of an isolation sleeve 110 has been positioned at the lower and intermediate bore seals 50*a-b* to seal off communication of the throughbore 32 with the snorkel tube 40. A standing valve 120 installs uphole of the isolation sleeve 110 and seals with the intermediate bore seal 50*b*, and the hydraulic piston pump 190 installs uphole of the standing valve 120 and seals with the upper bore seal 50*c*.

The standing valve 120 can be a separate component, which is installed after the equipment 30 has been installed and may not be attached to the hydraulic piston pump pump 190. Alternatively, the standing valve 120 can be installed on the hydraulic piston pump 190 and run in with it. Additionally, the isolation sleeve 110 can be run in place together with the other components of the standing valve 120 and pump 190.

Finally, the gas lift valve 100 can be already installed as part of the bottom hole assembly 20. Alternatively, should the valve 100 be removable in a side pocket mandrel, either the valve 100 is installed in the side pocket, or a dummy valve or blank is installed for simple closing off fluid communication.

Figure 8E:
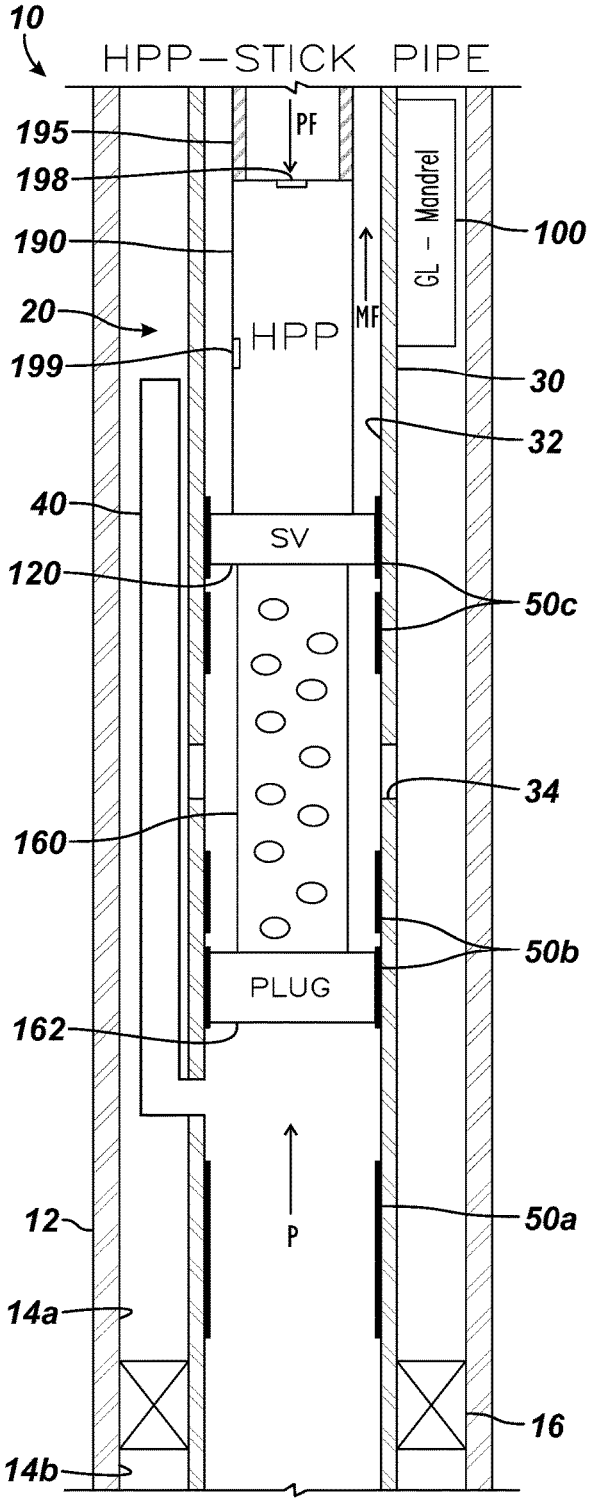
FIG. 8E illustrates the bottom hole assembly configured in another configuration for hydraulic lift using a hydraulic piston pump.
Figure 8B:
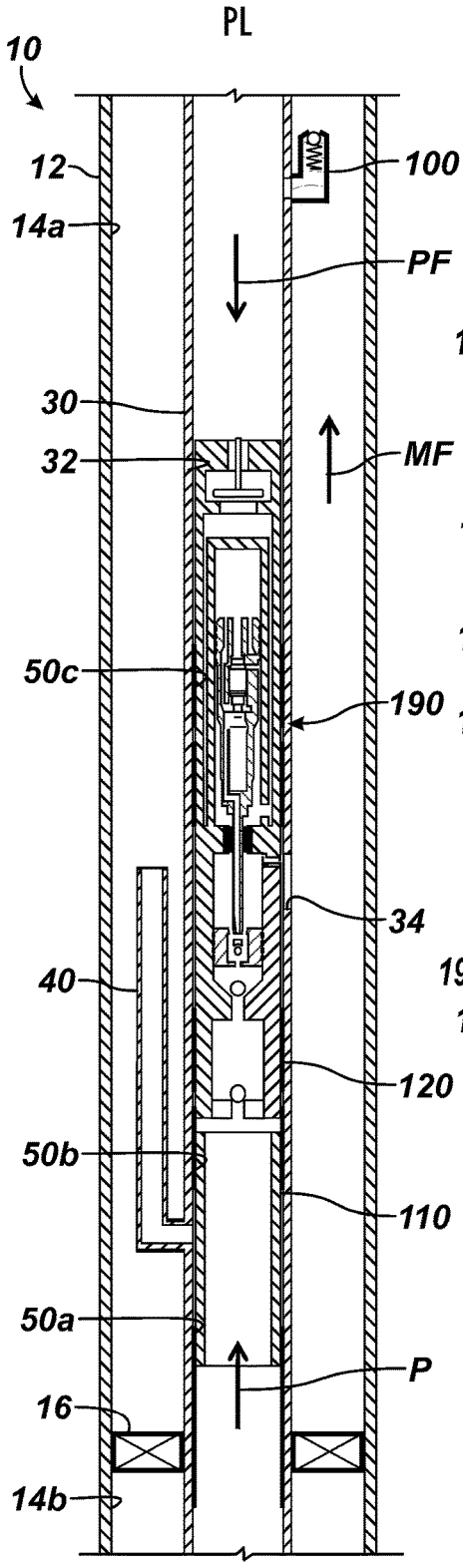
FIG. 8B illustrates the assembly of FIG. 8A in more detail.
Figure 8C:
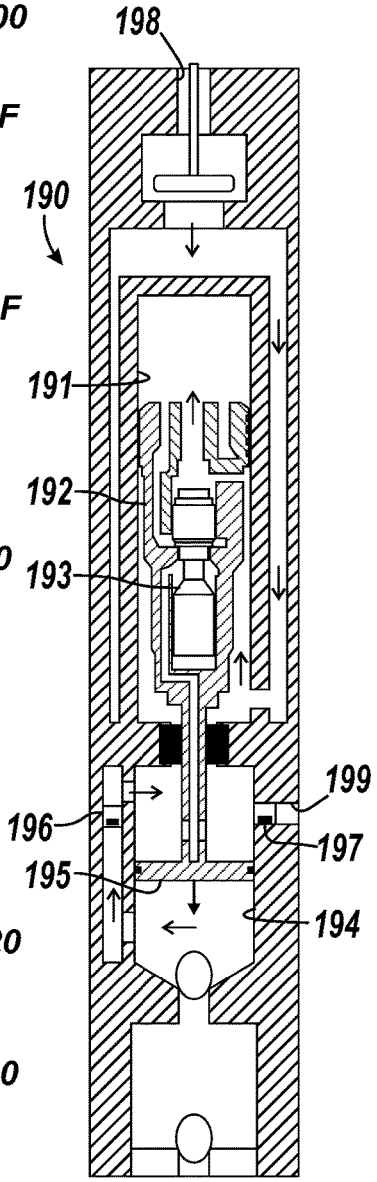
FIGS. 8C-8D illustrate a hydraulic piston pump in more detail respectively during downstroke and upstroke.
Figure 8D:
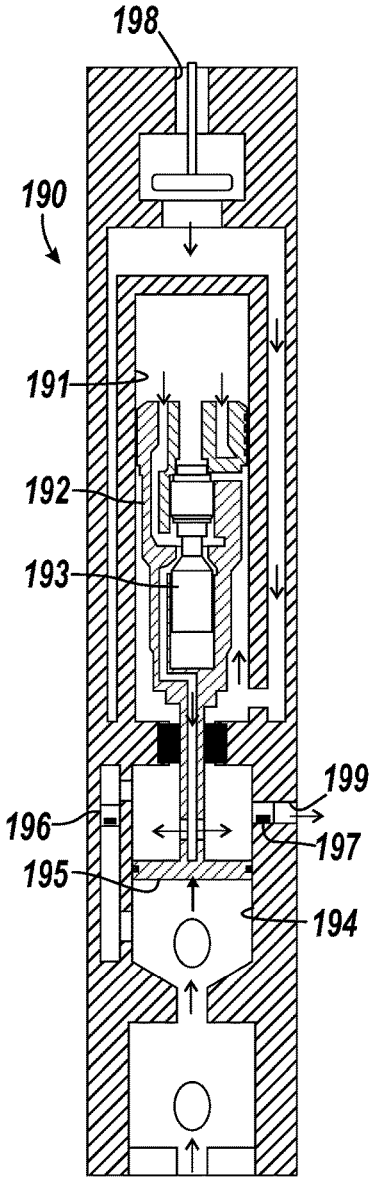

During the hydraulic pump lift operation shown in more detail in FIGS. 8B, 8C, and 8D, production fluid flowing up the throughbore 32 can pass through the standing valve 120 and enter the hydraulic piston pump 190 with the snorkel tube 40 isolated by the isolation sleeve 110. In this situation, gas and liquid may be able to enter the hydraulic piston pump 190, which may be less than ideal. Nevertheless, the piston pump 190 can be designed to avoid gas lock and is operated by a power fluid to produce strokes to lift production fluid to surface.

Briefly, the hydraulic piston pump 190 includes an engine barrel 191 in which an engine piston 192 can reciprocate. A reversing valve 193 is movably disposed in the engine piston 192 to control fluid communication to a pump barrel 194. For its part, the pump barrel 194 has a pump piston 195 that can reciprocate by the movement of the engine piston 192. A transfer valve 196 disposed in the pump piston 195 can capture fluid in the pump barrel 194 for eventual discharge through a discharge valve 197 at the outlet 199.

During operation, the engine barrel 191 receives pressurized power fluid from an input 198 exposed to the throughbore 32 uphole. The pressurized power fluid then drives both upstrokes and downstrokes in the pump 190 shown respectively in FIGS. 8C-8D. In general, production fluids are drawn into the pump barrel 194 during each upstroke (FIG. 8D). Spent power fluid remains in the engine barrel 191 after each downstroke (FIG. 8C) and is then routed into the pump barrel 194 during each upstroke (FIG. 8D). The comingled spent power fluid and the production fluid is then pumped out of the discharge valve 194 to the surface via the annulus 14*a*.

After each upstroke (FIG. 8D), for example, the pump piston 195 is at the top of the pump barrel 194. The lower section of the pump barrel 194 is full of liquids and gases that the piston 195 drew in during the upstroke. As each downstroke progresses, the pump piston 195 forces the reservoir liquids and gases into the upper portion of the pump barrel 194. After each downstroke (FIG. 8C), the pump piston 195 is at its lowest position in the pump barrel 194. The space above the pump piston 195 is full of reservoir liquids and gases that transferred there through the transfer valve 196 during the downstroke. As each upstroke progresses, the engine piston 192 forces spent power fluid out of the engine barrel 191 and into the pump barrel 194. Because the volume of the spent power fluid exceeds the pump-barrel volume, the pump barrel 194 empties completely, even if it is filled entirely with gas.

FIG. 8E illustrates the completion 10 with the bottom hole assembly 20 configured in another configuration for lift using a hydraulic piston pump 190. The arrangement in FIG. 8E is similar to that disclosed above with reference to FIG. 8A. Instead of using an isolation sleeve 110 and a standing valve 120, this configuration uses a perforated sub 160 with a plug 162 at its downhole end and with a standing valve 120 at its uphole end. The perforated sub 160 extends from the hydraulic piston pump 190 and communicates with the production ports 34. The snorkel tube 40 is allowed to communicate with the throughbore 32 downhole of the plug 162. The arrangement helps separate gas out so mainly liquid enters the hydraulic piston pump 190.

Additionally, in this configuration of FIG. 8E, the hydraulic piston pump 190 uses coiled tubing 195, pipe, or the like disposed from the surface through the throughbore 32 of the equipment 30. The tubing 195 communicates with the pump's input 198. In contrast, the pump's outlet 199 communicates with the resulting annulus in the throughbore 32. In this way, power fluid PF communicated down the coiled tubing 195 enters the pump 190, and the mixed fluid MF discharged from the pump 190 travels up the resulting annulus.

Figures 9A, 9B, 9C, 9D, 9E:
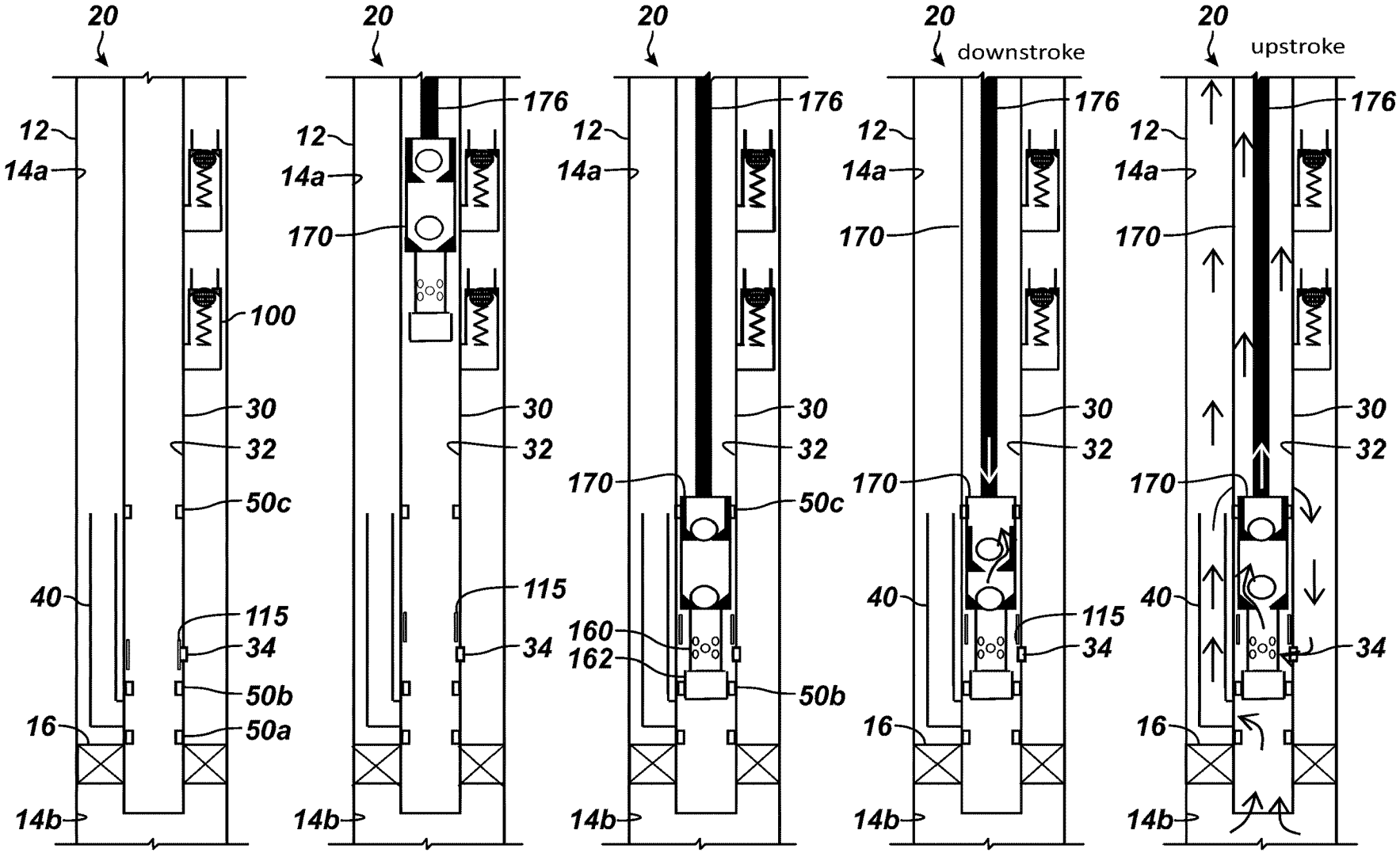
FIG. 9A illustrates portion of a completion system having another embodiment of a bottom hole assembly according to the present disclosure.
FIGS. 9B through 9E illustrate the bottom hole assembly configured for mechanical lift using a reciprocating rod pump.

In previous embodiments, removable isolation sleeves 110 and 140 have been used as isolation to isolate fluid communication through the bypass 40 and/or the production port 34. As an alternative, sliding sleeves can be incorporated in the production equipment 30 downhole and can be shifted to control communication through the snorkel tube 40 and/or the production port 34 for the isolation as needed. For example, FIG. 9A illustrates portion of a completion having another embodiment of a bottom hole assembly 20 according to the present disclosure. As before, the completion includes the casing 12 (or liner 15) for the well. The bottom hole packer 16 seals the annulus 14 of the casing 12 (or liner 15) with the production equipment 30 disposed in the casing 12.

The production equipment 30 includes the throughbore 32 having one or more production ports 34 communicating with the annulus 14. The production equipment 30 includes the snorkel tube 40 that extends uphole in the annulus 14 from the throughbore 32. A plurality of internal bore seals 50*b-c* are disposed in the throughbore 32 relative to the one or more ports 34 and the snorkel tube 40.

A sliding sleeve 115 is disposed on the production equipment 30 to selectively open/close fluid communication through the production ports 34. The sliding sleeve 115 can be manipulated using a shifting tool or the like to configure fluid communication through the ports 34 depending on the lift operation to be performed. In general, the sliding sleeve 115 can be used in place of the isolation sleeve of previous embodiments.

As depicted, the production equipment 30 can be integrated components having the above features formed as part of it. Alternatively and as is common, the production equipment 30 can include a plurality of interconnected housings, components, tubulars, and the like properly connected together to produce a tubular body. Accordingly, any conventional arrangement of elements can be combined together to facilitate manufacture and assembly of the production equipment 30.

Again, the bore seals 50*a-c* can include polished bores for engaging seals of lift equipment (not shown) disposed therein. In some implementations, the bore seals 50*a-c* may include seal rings, nipples, latch profiles, seats, and the like for engaging the lift equipment (not shown) removably disposed in the equipment's throughbore 32.

At the uphole end, the production equipment 30 includes the gas lift valve 100. Typically, the gas lift valve 100 can be an external valve positioned on a tubing mandrel for controlling communication from the casing annulus 14 into the tubing mandrel, which communicates with production throughbore 32. Such an external gas lift valve 100 can be installed at surface and run downhole with the production equipment 30. As an alternative, a side pocket mandrel can be disposed on the production equipment 30 and can hold a removable gas lift valve 100 therein. These and other forms of gas lift valves 100 can be used. Moreover, although only one gas lift valve 100 is shown, a given implementation may have multiple gas lift valves 100 along the production equipment 30.

FIGS. 9B through 9E illustrate the bottom hole assembly 20 of FIG. 9A being configured for mechanical lift using a reciprocating rod pump 170. As shown in 9B, the sliding sleeve 115 is opened to permit communication through the production port 34. Shifting of the sleeve 115 may be done in a separate operation before lift equipment is installed. With the sleeve 115 open, the rod pump 170, perforated sub 160, and plug 162 are lowered by the rod string 176 in the throughbore 32 to engage in the bore seals 50*b-c*, as shown in FIG. 9C. Then as shown in FIGS. 9D-9E, the plunger of the pump 170 can be reciprocated in downstrokes and upstrokes to lift fluid up the throughbore 32. The snorkel tube 40 helps to separate gas and liquid for the pump 170.

As will be appreciated with the benefit of the above description, the bottom hole assembly 20 of FIG. 9A having the sliding sleeve 115 for selectively opening/closing the production port 34 can be configured for any of the forms of artificial lift disclosed herein, with the sliding sleeve 115 operating in place of insertable isolation sleeves or other isolation disclosed herein as needed.

Figure 10A:
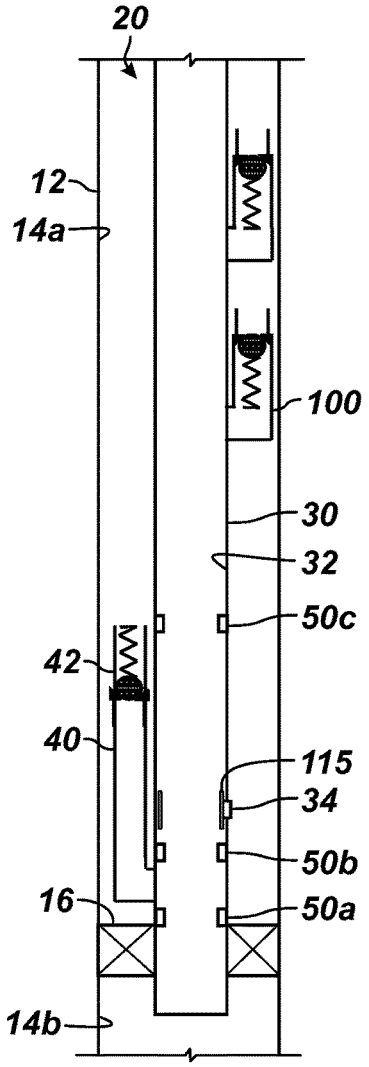
FIGS. 10A through 10C illustrate the bottom hole assembly having alternative forms of isolation.

Other forms of isolation can be provided for the production port 34 as well as the bypass 40. In another modification depicted in FIG. 10A, the bypass of the snorkel tube 40 may include a check valve 42 permitting communication of fluid from the snorkel tube 40 to the annulus 14*a*, but preventing flow in the reverse. In this way, the snorkel tube 40 can be used for downhole gas separation and for fluid communication in lift operations, such as the reciprocating rod pump lift (FIGS. 7A & 7E) and hydraulic piston pump lift (FIG. 8E). Yet, the snorkel tube 40 with the check valve 42 can also be used to prevent reverse flow in lift operations, such as hydraulic lift with hydraulic jet pump (FIG. 4A), gas lift (FIG. 5A), gas-assisted plunger lift (FIG. 6A), and hydraulic piston pump lift (FIG. 8A). Accordingly, the check valve 42 can supplement or take the place of the isolation disclosed in other embodiments.

Figure 10B:
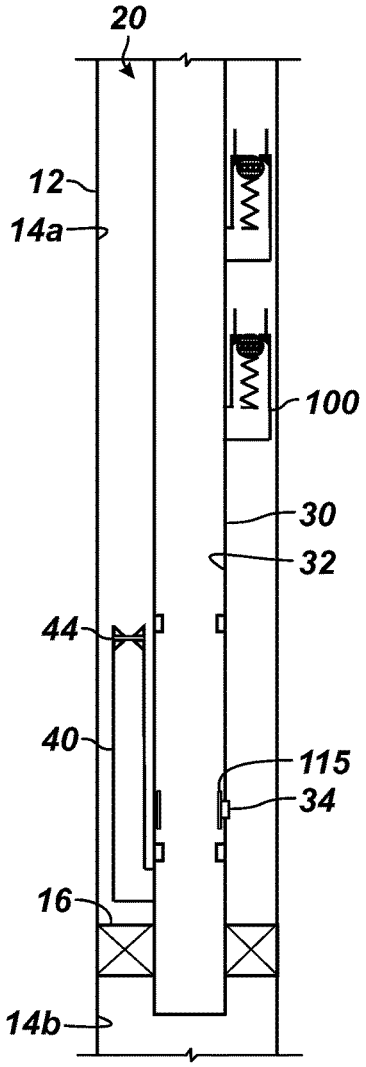

In yet another modification depicted in FIG. 10B, the bypass of the snorkel tube 40 may include a rupture disk or breachable obstruction 44 preventing flow through the snorkel tube 40 until needed. For example, the snorkel tube 140 can remain closed off during hydraulic jet pump lift (FIG. 4A), gas lift (FIG. 5A), gas-assisted plunger lift (FIG. 6A), and hydraulic piston pump lift (FIG. 8A). Then, when the assembly 20 is set up for rod pump operations (FIGS. 7A & 7E) and hydraulic piston pump lift (FIG. 8E), the rupture disk 44 can be breached to allow communication through the snorkel tube 40 for performing the downhole gas operation. Accordingly, the rupture disk 44 can supplement or take the place of the isolation disclosed in other embodiments.

Figure 10C:
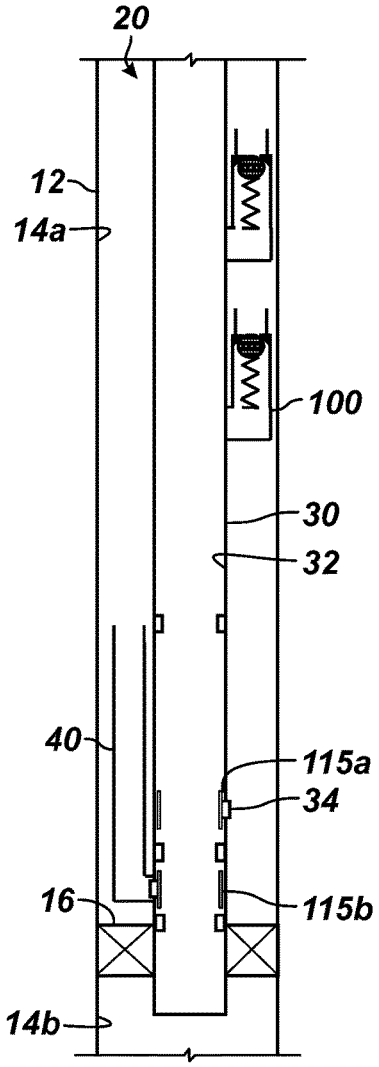

Finally, in the embodiment depicted in FIG. 10C, the bypass of the snorkel tube 40 may include a sliding sleeve 115*b* similar to the sliding sleeve 115*a* used for the production port 34. The snorkel's sliding sleeve 115*b* can selectively open and close fluid communication through the snorkel tube 40 for the particular lift arrangement. For example, the sliding sleeve 115*b* can close off the snorkel tube 40 during hydraulic jet pump lift (FIG. 4A), gas lift (FIG. 5A), gas-assisted plunger lift (FIG. 6A), and hydraulic piston pump lift (FIG. 8A), whereas the sliding sleeve 115*b* can open the snorkel tube 140 for rod pump operations (FIGS. 7A & 7E) and hydraulic piston pump lift (FIG. 8E). Accordingly, the second sliding sleeve 115*b* can supplement or take the place of the isolation disclosed in other embodiments. Because it may be the case that the snorkel tube 40 and the production ports 34 are both open in a given lift operation, then one sliding sleeve 115 can instead be used to selectively open/close both of the snorkel tube and the ports 34 at the same time.

Figure 11A:
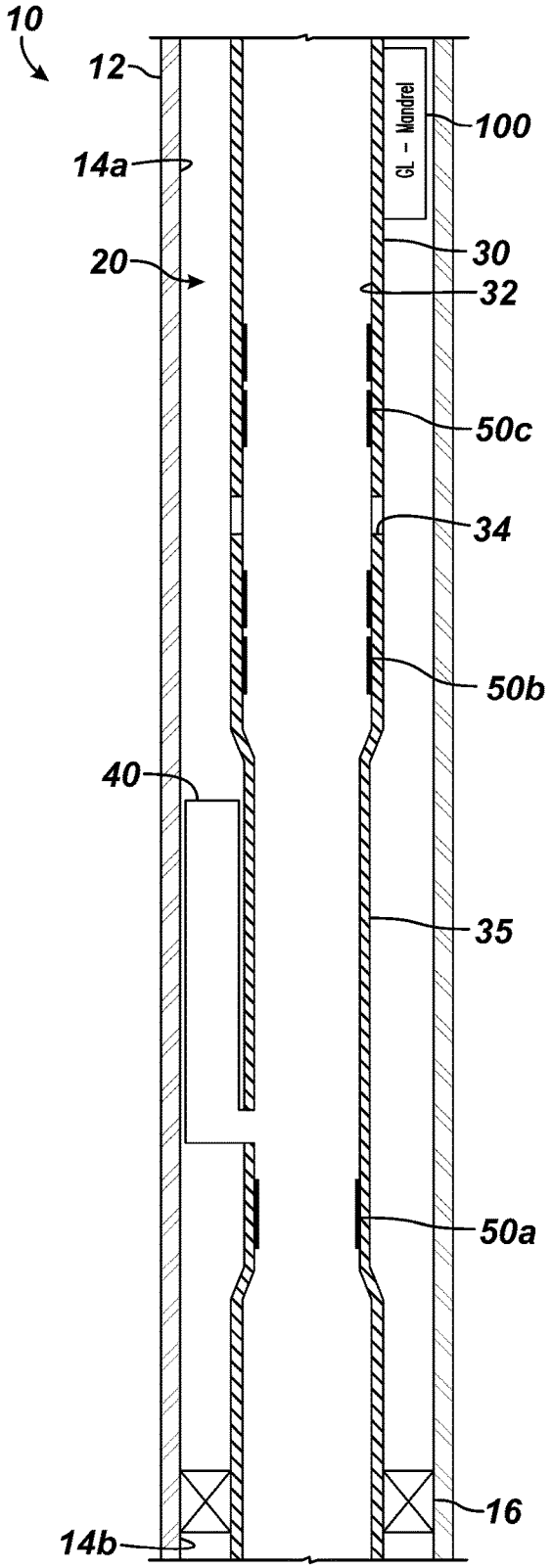
FIGS. 11A-11B illustrate alternative bottom hole assemblies for accommodating a bypass in a narrower annulus.
Figure 11B:
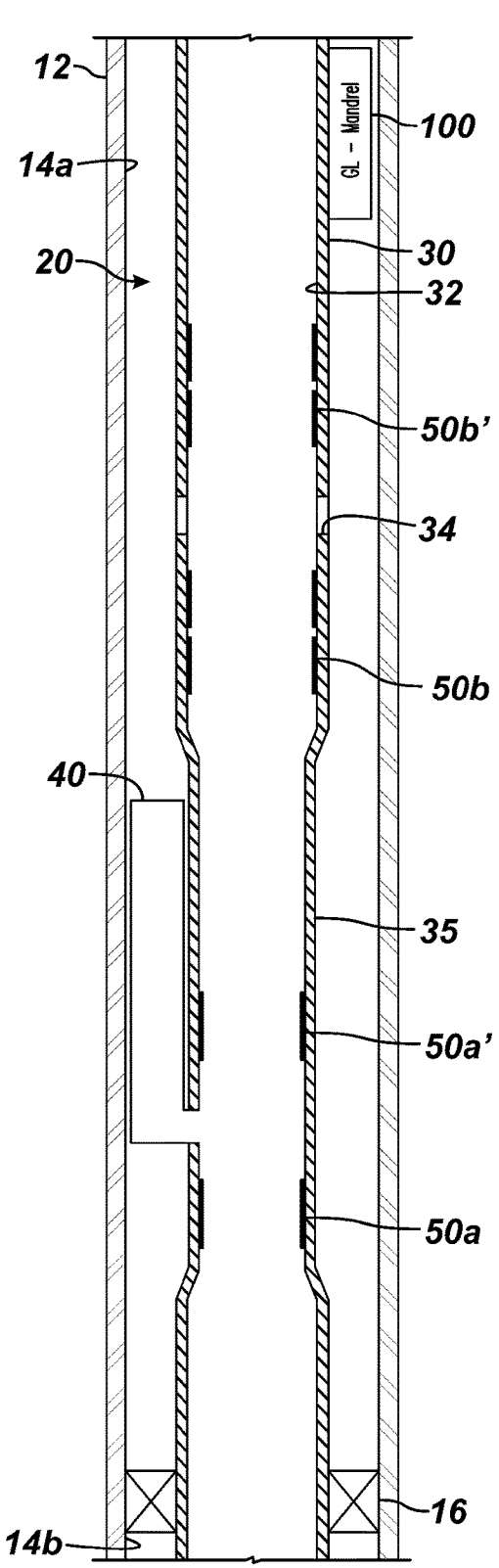

FIGS. 11A-11B illustrate alternative embodiments of bottom hole assemblies 20 for accommodating a bypass 140 in a narrower annulus 14*a*. In some implementations, the tubing-casing annulus 14*a* may not provide enough space to accommodate a bypass, such as the snorkel 40. As shown in FIGS. 11A-11B, an intermediate section 35 of the equipment 30 having a narrowing of the bore may be used to provide additional space in the annulus 14*a* to accommodate the bypass or snorkel 40. For example, for the casing 12 having a diameter of 5½-in. and the equipment 30 having a diameter of 2⅞-in., the intermediate sections 35 can accommodates a 2⅜-in. snorkel 40 that may extend for 25 to 30-ft. in the casing 12.

As shown in FIG. 11A, three bore seals 50*a-c* may still be used with the intermediate section 35 having the lower bore seal 50*a*. However, due to the narrowing of the bore 32 and the possible increased length at the intermediate section 35, the arrangement of the bore seals 50 can be changed. As shown in FIG. 11B, for example, the intermediate section 35 may include a pair of bore seals 50*a*-50*a*' for sealing to close of the bypass 40. Meanwhile, the bore 32 uphole of the intermediate section 35 may include another pair of bore seals 50*b*-50*b*' for sealing to close of the production port 34.

Figure 12:
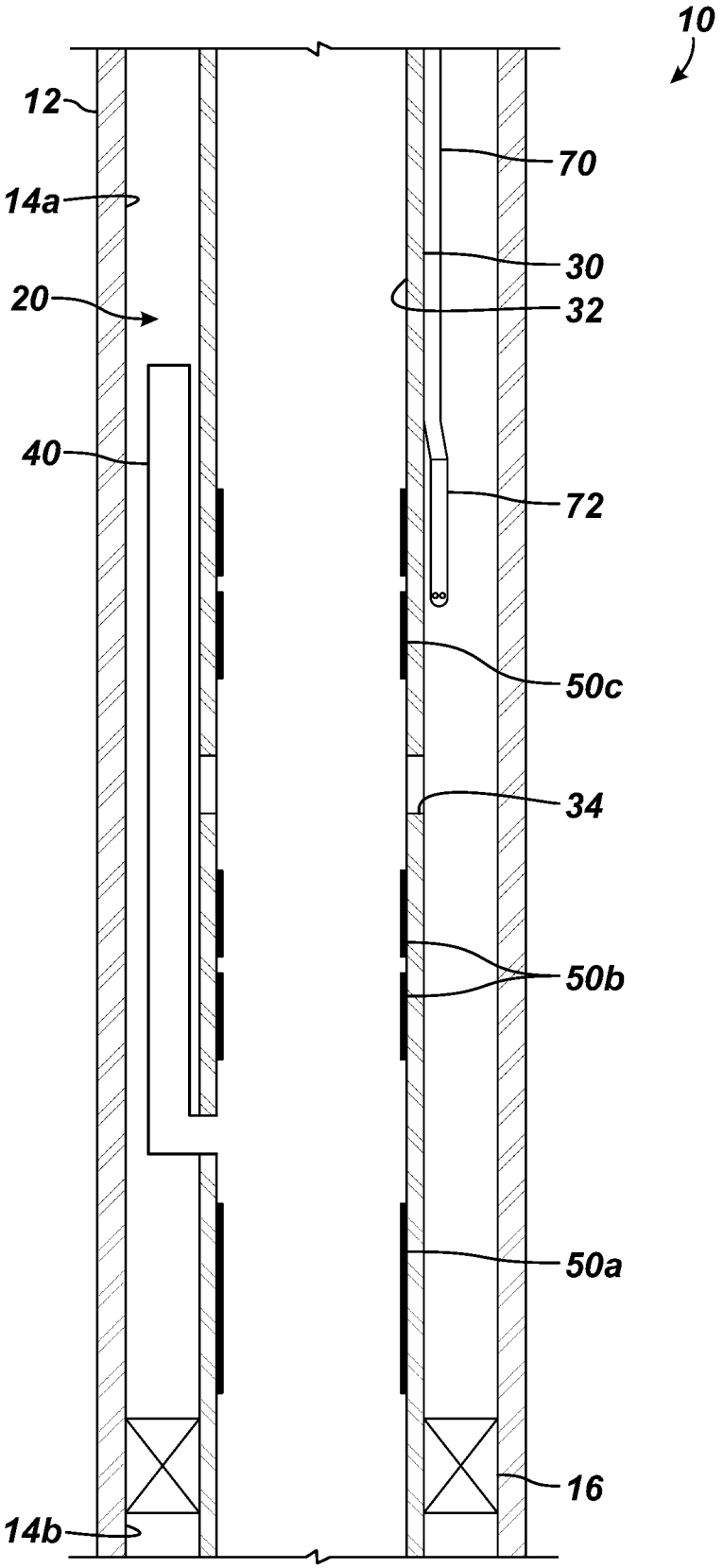
FIG. 12 illustrates an alternative bottom hole assembly having an injection valve on a capillary string.

FIG. 12 illustrates an alternative bottom hole assembly 20 having an injection valve 72 on a capillary string 70. Although not shown, a gas lift valve can also be present as in other embodiments. The capillary string 70 can be banded on the production equipment 30 and can communicate with surface equipment. The injection valve 72 connected to the string 70 can be placed in the vicinity of the bypass' exit (i.e., near the outlet of the snorkel 40) to inject chemicals, paraffin inhibitor, or the like. The injection process can achieve a number of purposes, such as helping with the gas separation achieved by the bypass 40, inhibiting condensate buildup in the annulus 14*a* above the packer 16, and the like.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A completion apparatus useable for artificial lift with production tubing in a wellbore, the apparatus comprising:

a downhole assembly disposed on the production tubing in the wellbore and defining a throughbore, the downhole assembly defining a production port communicating the throughbore with an annulus of the wellbore;

a packer disposed on the downhole assembly and sealing the annulus downhole of the production port;

a bypass disposed on the downhole assembly, the bypass communicating with the throughbore between the packer and the production port and communicating with the annulus;

at least one isolation disposed on the downhole assembly and being selectively configured in at least two configurations, the at least two configurations being selected from: (i) a first configuration configured to prevent the communication via the bypass and allow the communication via the production port, and (ii) a second configuration configured to allow communication via both the production port and the bypass; and at least two types of lift equipment selectively insertable into the throughbore in place of one another and configuring the downhole assembly for at least two forms of artificial lift, a first of the at least two forms being different from a second of the at least two forms.

2. The apparatus of claim 1, wherein the downhole assembly comprises a plurality of bore seals disposed in the throughbore and selectively sealing with the at least two types of lift equipment inserted into the throughbore.

3. The apparatus of claim 2, wherein the plurality of bore seals comprise:

a first of the bore seals disposed in the throughbore downhole of the communication of the bypass;

a second of the bore seals disposed in the throughbore between the production port and the communication of the bypass; and a third of the bore seals disposed in the throughbore uphole of the production port.

4. The apparatus of claim 1, wherein the at least one isolation comprises at least one sleeve insert selectively insertable into the throughbore and sealable therein relative to one or both of the production port and the bypass.

5. The apparatus of claim 1, wherein the at least one isolation comprises at least one sliding sleeve movably disposed in the throughbore between open and closed conditions relative to one or both of the production port and the bypass.

6. The apparatus of claim 1, wherein the at least one isolation comprises a check valve or a rupture disk controlling communication via the bypass.

7. The apparatus of claim 1, further comprising an injection valve disposed on the downhole assembly adjacent the bypass and communicating a capillary string from surface with the annulus of the wellbore.

8. The apparatus of claim 1, wherein the downhole assembly is configured for hydraulic lift as one of the at least two forms of artificial lift with the at least one isolation being configured in the first configuration to prevent the communication via the bypass and allowing the communication via the production port; and wherein one of the at least two types of lift equipment comprises:

a hydraulic jet pump inserted in the throughbore, the hydraulic jet pump having an inlet receiving production fluid from the downhole throughbore; and a standing valve disposed at the inlet of the hydraulic jet pump.

9. The apparatus of claim 8, wherein:

the hydraulic jet pump comprises an input receiving power fluid from the uphole throughbore, and comprises an outlet in communication with the annulus via the production port for discharging mixed production and power fluid; or the hydraulic jet pump comprises an input in communication with the annulus via the production port for receiving power fluid, and comprises an outlet in communication with the uphole throughbore for discharging mixed production and power fluid.

10. The apparatus of claim 1, wherein the downhole assembly is configured for mechanical lift as one of the at least two forms of artificial lift with the at least one isolation being configured in the second configuration to allow the communication via both the bypass and the production port; and wherein one of the at least two types of lift equipment comprises:

an inlet inserted in the throughbore and sealed in fluid communication with the production port; and a reciprocating rod pump inserted in the throughbore uphole of the production port and receiving production fluid from the production port via the inlet.

11. The apparatus of claim 10, wherein the inlet comprises:

a permeable conduit inserted in the throughbore adjacent the production port;

a plug disposed on a downhole end and sealed in a lower seal bore of the throughbore; and a holddown disposed on an uphole end and sealed in an upper seal bore of the throughbore.

12. The apparatus of claim 10, wherein the lift equipment comprises an anchor inserted in the throughbore uphole of the inlet; and wherein the reciprocating rod pump is inserted in the throughbore uphole of the anchor and receives production fluid from the production port through the inlet and the anchor.

13. The apparatus of claim 12, wherein the inlet comprises:

a permeable conduit inserted in the throughbore adjacent the production port; and a plug disposed on a downhole end of the lift equipment and sealed in a lower seal bore of the throughbore.

14. The apparatus of claim 1, wherein the downhole assembly is configured for hydraulic lift as one of the at least two forms of artificial lift with the at least one isolation being configured in the first configuration to prevent the communication via the bypass and allow the communication via the production port; and wherein one of the at least two types of lift equipment comprises:

a hydraulic piston pump inserted in the throughbore, the hydraulic piston pump having an inlet receiving production fluid from the downhole throughbore, an input receiving power fluid, and an outlet for mixed production and power fluid, the outlet port in communication with the production port; and a standing valve disposed at the inlet of the hydraulic piston pump.

15. The apparatus of claim 1, wherein the downhole assembly is configured for hydraulic lift as one of the at least two forms of artificial lift with the at least one isolation being configured in the second configuration to allow the communication via both the bypass and the production port; and wherein one of the at least two types of lift equipment comprises:

an inlet inserted in the throughbore and sealed in fluid communication with the production port;

a hydraulic piston pump inserted in the throughbore uphole of the inlet, the hydraulic piston pump receiving production fluid from the production port via the inlet, an input for power fluid, and an outlet for mixed production and power fluid, the outlet in fluid communication with the uphole throughbore;

a standing valve disposed at the inlet of the hydraulic piston pump; and a second conduit disposed in the uphole throughbore and communicating with the input of the hydraulic piston pump.

16. The apparatus of claim 1, wherein the at least two configurations are further selected from: (iii) a third configuration being configured to prevent communication via both of the production port and the bypass.

17. The apparatus of claim 16, wherein a first of the at least two types of lift equipment inserted into the throughbore having the at least one isolation configured in one of the first, second, and third configurations configures the downhole assembly for the first of the at least two forms of artificial lift, and wherein a second of the at least two types of lift equipment inserted into the throughbore having the at least one isolation configured in the one or another of the first, second, and third configurations configures the downhole assembly for the second of the at least two forms of artificial lift.

18. The apparatus of claim 16, wherein the downhole assembly comprises a gas lift valve disposed thereon and controlling communication between the annulus and the throughbore; and wherein the downhole assembly is configured for gas lift as a third of the at least two forms of artificial lift with the at least one isolation being configured in the third configuration to preventing the communication via both the bypass and the production port and without the at least two types of lift equipment inserted into the throughbore.

19. The apparatus of claim 16, wherein the downhole assembly comprises a gas lift valve disposed thereon and controlling communication between the annulus and the throughbore; wherein the downhole assembly is configured for hydraulic lift as one of the at least two forms of artificial lift with the at least one isolation being configured in the third configuration to prevent the communication via both the bypass and the production port; and wherein one of the at least two types of lift equipment comprises:

a plunger assembly inserted in the throughbore adjacent the gas lift valve and having an inlet receiving production fluid from downhole; and a standing valve disposed at the inlet of the plunger assembly.

20. The apparatus of claim 16, wherein the downhole assembly is configured for hydraulic lift as one of the at least two forms of artificial lift with the at least one isolation being configured in the third configuration to preventing the communication via both the bypass and the production port; and wherein one of the at least two types of lift equipment comprises:

a plunger assembly inserted in the throughbore and having an inlet receiving production fluid from downhole; and a standing valve disposed at the inlet of the plunger assembly.

21. A method for completing a wellbore for multiple forms of artificial lift, the method comprising:

disposing a downhole assembly on production tubing in the wellbore, the downhole assembly defining a throughbore and defining a production port communicating the throughbore with an annulus of the wellbore, the downhole assembly having a bypass communicating with the throughbore between the packer and the production port and communicating with the annulus;

sealing a packer on the downhole assembly in the annulus downhole of the production port; and configuring the downhole assembly for at least two of the multiple forms of artificial lift by:

selectively configuring communication with at least one isolation in at least two configurations selected from: a first configuration preventing the communication via the bypass and allowing the communication via the production port, and a second configuration allowing communication via both the production port and the bypass; and selectively inserting at least two types of lift equipment into the throughbore in place of one another and configured for the selected at least two forms of artificial lift.

22. The method of claim 21, wherein selectively inserting the at least two types of lift equipment into the throughbore comprises selectively sealing one or more components of the inserted lift equipment with one or more of a plurality of bore seals disposed in the throughbore.

23. The method of claim 22, wherein the plurality of bore seals comprise:

a first of the bore seals disposed in the throughbore downhole of the communication of the bypass;

a second of the bore seals disposed in the throughbore between the production port and the communication of the bypass; and a third of the bore seals disposed in the throughbore uphole of the production port.

24. The method of claim 21, wherein selectively inserting the at least two types of lift equipment into the throughbore comprises one or more of:

inserting multiple components of the inserted lift equipment integrated together;

running more than one component of the inserted lift equipment together at a same time into the throughbore; and running one or more components of the inserted lift equipment in the throughbore using one of wireline, slickline, and coiled tubing.

25. The method of claim 21, wherein selectively configuring the communication with the at least one isolation in the at least two configurations comprises one of:

selectively inserting at least one sleeve insert as the at least one isolation into the throughbore and sealable therein relative to one or both of the production port and the bypass;

moving at least one sliding sleeve insert as the at least one isolation in the throughbore between open and closed conditions relative to one of the production port and the bypass;

controlling communication via the bypass with a check valve as the at least one isolation; and controlling communication via the bypass with a rupture disk as the at least one isolation.

26. The method of claim 21, wherein configuring the downhole assembly further comprises configuring the downhole assembly for gas lift as a third of the at least two forms of artificial lift by:

configuring conduction of production fluid with the at least one isolation configured in a third of the at least two configurations by preventing the communication via both of the production port and the bypass; and controlling communication of gas from the annulus into the production fluid in the throughbore without the at least two types of lift equipment inserted into the throughbore.

27. The method of claim 21, wherein configuring the downhole assembly comprises configuring the downhole assembly for hydraulic lift as one of the at least two forms of artificial lift by:

configuring conduction of production fluid with the at least one isolation configured in the first configuration by preventing the communication via the bypass and allowing the communication via the production port;

inserting a hydraulic jet pump as one of the at least two types of lift equipment in the throughbore, the hydraulic jet pump having an inlet receiving production fluid from the downhole throughbore, an input receiving power fluid from the uphole throughbore, and an outlet for mixed production and power fluid, the outlet port in communication with the annulus via the production port; and positioning a standing valve at the inlet of the hydraulic jet pump.

28. The method of claim 21, wherein configuring the downhole assembly comprises configuring the downhole assembly for gas-assisted plunger lift as one of the at least two forms of artificial lift by:

configuring conduction of production fluid with the at least one isolation configured in a third of the at least two configurations by preventing the communication via both the bypass and the production port;

controlling communication of gas from the annulus into the production fluid in the throughbore with a gas lift valve as one of the at least two types of lift equipment disposed on the downhole assembly;

inserting a plunger assembly in the throughbore adjacent the gas lift valve and having an inlet receiving production fluid from downhole; and positioning a standing valve at the inlet of the plunger assembly.

29. The method of claim 21, wherein configuring the downhole assembly comprises configuring the downhole assembly for mechanical lift as one of the at least two forms of artificial lift by:

configuring conduction of production fluid with the at least one isolation configured in the second configuration by allowing the communication via both the bypass and the production port;

inserting an inlet in the throughbore and sealed in fluid communication with the production port; and inserting a reciprocating rod pump as one of the at least two types of lift equipment in the throughbore uphole of the inlet to receive the production fluid from the production port via the inlet.

30. The method of claim 29, wherein inserting the inlet in the throughbore and sealed in fluid communication with the production port comprises inserting an anchor in the throughbore uphole of the inlet; and wherein inserting the reciprocating rod pump comprises inserting the reciprocating rod pump in the throughbore uphole of the anchor to receive the production fluid from the production port through the inlet and the anchor.

31. The method of claim 21, wherein configuring the downhole assembly comprises configuring the downhole assembly for hydraulic lift as one of the at least two forms of artificial lift by:

configuring conduction of production fluid with the at least one isolation configured in the first configurations by preventing the communication via the bypass and allowing the communication via the production port;

inserting a hydraulic piston pump as one of the at least two types of lift equipment in the throughbore, the hydraulic piston pump having an inlet receiving production fluid from the downhole throughbore, an input receiving power fluid, and an outlet for mixed production and power fluid, the outlet port in communication with the production port; and positioning a standing valve at the inlet of the hydraulic jet pump.

32. The method of claim 21, wherein configuring the downhole assembly comprises configuring the downhole assembly for hydraulic lift as one of the at least two forms of artificial lift by:

configuring conduction of production fluid with the at least one isolation configured in a third of the at least two configurations by allowing the communication via both the bypass and the production port;

inserting an inlet in the throughbore and sealed in fluid communication with the production port;

inserting a hydraulic piston pump as one of the at least two types of lift equipment in the throughbore uphole of the inlet, the hydraulic piston pump receiving production fluid from the production port via the inlet, an input for power fluid, and an outlet for mixed production and power fluid, the outlet in fluid communication with the uphole throughbore;

positioning a standing valve at the inlet of the hydraulic piston pump; and positioning a second conduit in the uphole throughbore to communicate with the input of the hydraulic piston pump.

33. The method of claim 21, wherein configuring the downhole assembly comprises:

operating a hydraulic jet pump inserted in the throughbore relative to the bypass and the production port, the at least one isolation being configured in the first configuration configured to prevent the communication of the production fluid via the bypass and configured to allow the communication of the production fluid via the production port; and transitioning from the hydraulic jet pump to at least one of a hydraulic piston pump and a rod pump by removing the hydraulic jet pump from the throughbore, configuring conduction of production fluid with the at least one isolation being configured in the second configuration to allow the communication via both the bypass and the production port, and inserting the at least one of the hydraulic piston pump and the rod pump in the throughbore relative to the bypass and the production port.

* * * * *